US006922920B1

(12) United States Patent
Stratz

(10) Patent No.: US 6,922,920 B1
(45) Date of Patent: Aug. 2, 2005

(54) SNOW REMOVAL DEVICE

(76) Inventor: Anthony Stratz, 407 N. Second St., Emmaus, PA (US) 18049

( * ) Notice: Subject to any disclaimer, the term of this patent is extended or adjusted under 35 U.S.C. 154(b) by 0 days.

(21) Appl. No.: 10/613,466

(22) Filed: Jul. 3, 2003

(51) Int. Cl.[7] ..... E01H 5/02

(52) U.S. Cl. ..... 37/197; 37/265; 37/285; 294/50.7; 294/50.9; 294/53.5; 294/54.5; 294/55; 294/60; D08/10; D08/106; D08/308

(58) Field of Search ..... 37/264–285, 196, 37/214, 219, 220, 241, 381, 398, 399, 903, 37/407–411, 197; 294/49, 50.6–60; D08/1, D08/7, 10, 106, 307–309

(56) References Cited

U.S. PATENT DOCUMENTS

| | | | |
|---|---|---|---|
| 258,260 | A | 5/1882 | Staples |
| 584,827 | A | 6/1897 | McIndoo |
| 738,057 | A | 9/1903 | O'Connor |
| 2,239,297 | A | 4/1941 | Allen et al. |
| 2,734,291 | A | 2/1956 | Lasker |
| 2,769,612 | A | 11/1956 | Weisheit |
| 2,896,993 | A | 7/1959 | Pollock |
| 3,035,816 | A | 5/1962 | Conant |
| 3,043,033 | A | 7/1962 | Ingram et al. |
| 3,063,174 | A | 11/1962 | Ludin |
| 3,121,963 | A | 2/1964 | Nolan |
| D206,177 | S | 11/1966 | Unruh |
| 3,343,807 | A | 9/1967 | Moraski |
| 3,475,838 | A | 11/1969 | Hagen et al. |
| 3,583,746 | A | 6/1971 | Lissakers |
| 3,748,761 | A | 7/1973 | Chetwynde |
| 3,923,331 | A | 12/1975 | Hollnagel |
| 3,964,182 | A | 6/1976 | Pomeret et al. |
| 4,125,951 | A | 11/1978 | Huerth |
| 4,130,953 | A | 12/1978 | Bruno |
| 4,161,073 | A | 7/1979 | Oakes |
| 4,198,090 | A | 4/1980 | Gutman |
| 4,224,751 | A | 9/1980 | Schoemann et al. |
| 4,231,604 | A | 11/1980 | Obergfell |
| 4,253,257 | A | 3/1981 | Albert |
| 4,302,894 | A | 12/1981 | Emma |
| D275,928 | S | 10/1984 | LoPresti |
| 4,531,713 | A | 7/1985 | Balboni |
| 4,537,433 | A | 8/1985 | Yang |
| 4,559,726 | A | 12/1985 | Moisan |
| 4,772,057 | A | 9/1988 | Harvey |
| 4,804,219 | A | 2/1989 | Berg |
| 4,881,332 | A | 11/1989 | Evertsen |
| D307,378 | S | 4/1990 | D'Alessandro |
| D314,318 | S | 2/1991 | Uimonen |
| 5,018,282 | A | 5/1991 | Hong |
| 5,056,245 | A | 10/1991 | Jenkins et al. |
| 5,074,064 | A | 12/1991 | Nickels |

(Continued)

*Primary Examiner*—Christopher J. Novosad
(74) *Attorney, Agent, or Firm*—Charles A. Wilkinson; Clinton H. Wilkinson

(57) ABSTRACT

A snow removal apparatus in the form of a shovel in which a leveraged arrangement is used to lift snow gathered on the shovel blade by lateral movement of such blade while supported by a handle adjustably secured upon the blade and the shovel handle is rested upon an underlying surface while snow is being lifted and moved to a dumping area by leveraged foot movement upon a pivot arm pivoted upon the handle and attached to the blade thus avoiding strain on a shovelers arms and spine while shoveling.

22 Claims, 17 Drawing Sheets

U.S. PATENT DOCUMENTS

| | | | |
|---|---|---|---|
| 5,271,169 | A | 12/1993 | Konsztowicz |
| 5,440,828 | A | 8/1995 | Simpson |
| 5,511,327 | A | 4/1996 | Jurkowski et al. |
| D375,235 | S | 11/1996 | Spear et al. |
| 5,581,915 | A | 12/1996 | Lobato |
| 5,593,198 | A | 1/1997 | Vogel, II |
| D378,890 | S | 4/1997 | Furno |
| D383,582 | S | 9/1997 | Sinclair, Jr. |
| 5,669,651 | A | 9/1997 | Vroegindewey |
| 5,732,933 | A | 3/1998 | Champi |
| 5,791,072 | A | 8/1998 | Schbot |
| 5,863,084 | A | 1/1999 | Krug |
| D407,723 | S | 4/1999 | Weisman et al. |
| 5,918,921 | A | 7/1999 | Samuelson |
| 5,984,393 | A | 11/1999 | Washington |
| 6,053,548 | A | 4/2000 | Bowles, Jr. |
| 6,086,049 | A | 7/2000 | Sheils |
| 6,203,081 | B1 | 3/2001 | Kegan, Sr. |
| D459,641 | S | 7/2002 | Guneysu |
| 6,457,757 | B2 | 10/2002 | Hendrick |
| 6,485,076 | B1 | 11/2002 | Chang |

Fig. 15

| BILL OF MATERIALS | | | |
|---|---|---|---|
| ITEM | QTY | DESCRIPTION | DRAWING NO. |
| 1 | 1 | SHOVEL LIFTING LOOP | 62003-101 |
| 2 | 2 | JOINING TUBE INSERT | 62003-102 |
| 3 | 2 | LIFT RELEASE MOUNTING BRACKET | 62003-103 |
| 4 | 1 | LIFT RELEASE ROD | 62003-104 |
| 5 | 2 | LIFT FRAME, COMMON | 62003-105 |
| 6 | 2 | LIFT TUBE INSERT | 62003-106 |
| 7 | 2 | MAIN FRAME TUBE | 62003-107 |
| 8 | 2 | NO SKID INSERT | 62003-108 |
| 9 | 1 | RATCHET WHEEL | 62003-109 |
| 10 | 1 | RATCHET WHEEL MOUNTING SPACER | 62003-110 |
| 11 | 1 | RATCHET WHEEL SPACER BUSHING | 62003-111 |
| 12 | 2 | CURVED FILLER TUBE | 62003-112 |
| 13 | 2 | WHEEL MOUNTING BRACKET | 62003-113 |
| 14 | 4 | SHOVEL MOUNTING BRACKET | 62003-114 |
| 15 | 1 | SHOVEL RELEASE CABLE BRACKET | 62003-115 |
| 16 | 1 | SHOVEL RELEASE HOOK | 62003-116 |
| 17 | 2 | SHOVEL RELEASE HOOK MOUNTING BRACKET | 62003-117 |
| 18 | 1 | SHOVEL WEAR STRIP | 62003-118 |
| 19 | 4 | STRESS PLATE | 62003-119 |
| 20 | 1 | SHOVEL | 62003-120 |
| 21 | 1 | SHOVEL DUMP ACTUATOR | TBD |
| 22 | 2 | WHEEL, McMASTER CARR | TBD |

SNOW REMOVAL DEVICE

BACKGROUND OF THE INVENTION

1. Field of the Invention

The present invention relates to manually operated shoveling and plowing devices, and more particularly to a manually operated shoveling device capable of scraping and gathering, lifting, and dumping large quantities of a granular or other material such as snow quickly and with a minimal amount of physical exertion and strain on the operator.

2. Preliminary Discussion

Well known is the fact that shoveling snow with a conventional shovel is very labor intensive and places considerable stress on the shoveler's body. A Journal of the American Medical Association study found that people who rarely exercise are up to 30 times more likely to have a heart attack when suddenly undertaking a strenuous activity such as snow shoveling. The physical labor of shoveling quickly drives up one's blood pressure and heart rate, particularly in those people who are out of shape and not used to regular physical exertion. Cold weather only adds to the stress, because the cold tends to constrict blood vessels, not only at the surface of the body, but generally, while at the same time extra blood is needed flowing to the heart to compensate for the workout. The main reason for the initiation of such injury during shoveling is that the amount of stress exerted is usually underestimated by the shoveler. Researchers in Michigan recently monitored the vital statistics of 10 healthy men in their 20's and 30's, including heart rate, as they ran on a treadmill to the point of exhaustion. Shortly thereafter, the same group was monitored as they shoveled heavy, wet snow for about ten minutes. The results showed that the men's heart rates during or after shoveling were at least as high or higher than their heart rates on the treadmill.

In addition to risk of heart attacks, the stress of shoveling can lead to other serious physical injuries, the most serious of which are usually back injuries. In fact, although one might think that older individuals are more at risk of suffering a back injury while shoveling, shovelers between the ages of 20 and 50 are generally more likely to suffer a back injury than older individuals, because older individuals are more likely to be aware they are out of condition, and therefore more likely to "take it easy" so to speak. The risk of suffering a back injury is also more likely in the morning because the tissue around the shoveler's spine is not warmed up or loose. Many slipped discs also occur in the morning when there is increased fluid pressure in the cerebrospinal fluid which increased pressure is exerted upon and internally of the disc. Resulting "over inflation" of the disc increases the likelihood of the top and bottom of the disc moving laterally relative to each other.

Use of proper lifting technique and shoveling at a slower, steady pace can greatly reduce the risk of injury while shoveling. For example, in lifting a loaded shovel, the shoveler should bend his or her knees while lifting with the legs and not with the back. Excessive twisting, bending or throwing snow over the shoulder should be avoided to prevent spinal injury, as the spine can tolerate almost any other movement more easily than twisting. Stepping in the direction the snow is being thrown will also prevent some twisting. In addition, smaller shovel loads should be lifted rather than heavy or full shovel loads. Frequent breaks should be taken, and the lower back should be extended either by walking around or doing extension exercises by placing one's hands on the back of his or her hips and bending forward slightly for several seconds, and then bending backward also for several seconds.

Despite such precautions, which are not taken by most or even many shovelers, muscle fatigue, low back strain, vertebral disc damage, and even spinal fractures occur during the winter season, caused either by excessive stress to spinal structures and others by slip and fall accidents. Thus, since most of such shoveling injuries occur as a result of lifting and throwing or dumping loads of snow, an even better solution to preventing injuries to one's back or other muscles is to push the snow to the grassy area beside a sidewalk or driveway instead of lifting and throwing it. Some back injuries occur due to the fact that the shaft of the shovel is too short, which causes the back to bend more to lift the load, or by using a shovel with a shaft that is too long, the resulting excessive leverage effectively making the weight at the end relatively heavier. In addition, several shovels today have curved shafts or handles which enable the user to keep his or her back straight or straighter while lifting and reduce the amount of bending required during use. Such curved shaft shovels, however, in general place even more stress on the body if the snow has to be lifted up to or over a pile of previously collected snow or other barrier. Other snow handlers choose to do away with manual shoveling altogether, and instead use a snow blower. However, while snow blowers do in fact eliminate lifting of snow, they are quite expensive to purchase and maintain, and can be dangerous if not used or cleaned correctly. In fact, hand injuries caused by cleaning out a snow blower by hand are quite common, despite repeated warnings. Snow blowers, furthermore, are inefficient with heavy wet snow, which is also the most difficult to move by means of a shovel.

As discussed in more detail in reviewing the prior art references below, in an attempt to reduce the exertion and amount of lifting required, the principle of leverage has been adopted for use in various shovel arrangements. In most cases, the shovel shaft or handle acts as an extended lever which is pivoted against a fulcrum attachment to lift a load, in this case a shovel blade loaded with snow. Essentially, by applying a downward lift force on the lever, the amount of work required to lift the loaded shovel is reduced. The human body or more specifically the arm is itself essentially a third class lever, i.e. the fulcrum point is at the end of the lever and the exertion of force is between the fulcrum point and the point at which force is to be exerted. However, third class levers offer no advantage to gravity in terms of power, since they require more force to move against the force of gravity than the weight to be moved. For example, to lift twenty pounds with one's hand, the arm muscles actually put about two hundred pounds of force on the forearm, so that the force that goes into the body is approximately ten times the force being lifted. Therefore, while third class levers such as the human body or more particularly the arms are good for mobility and speed, they are very inefficient in terms of lifting against the force of gravity and/or in terms of energy. In addition, the load is supported by an articulated but only partially flexible column represented by the spinal column maintained in alignment by multiple individual muscles and tendons which must operate in complete coordination to prevent misarticulation, which is a primary reason why back injuries often occur while lifting heavy items. The entire weight, whatever it is furthermore in shoveling, is exerted upon the spinal column with a significant twisting moment made greater by the length of the shovel handle. Second class levers, an example of which is a wheelbarrow, where the weight of the load is exerted between the fulcrum point and the point of exertion of lifting force and thus attains a mechanical advantage, offer some additional mechanical advantage, but the load is still essentially placed so that to get any such mechanical advantage, one is still lifting up against the force of gravity. In a wheelbarrow, the load is situated essentially behind or right over the fulcrum, and one must lift up against gravity to move the load. In a first class lever, however, such as a shovel having a fulcrum type attachment, one pushes down in the same direction as the force of gravity on the handle, which is easier than lifting against gravity, causing the other loaded end to be lifted upwardly. The longer the lever on the down side of the fulcrum in comparison to the load side, the less effective force is required to lift the load. Approximately thirty-three pounds of down force on one side of the lever, which force is enhanced by the force of gravity, is translated into a hundred pounds of up force on the opposite side of the lever if the downward force application side is three times as long as the lift side.

The present inventor has conceived of a novel snow shoveling device wherein all of the lift required in lifting a load of snow comes from a unique first class lever arrangement in which the handle of the shovel serves as the fulcrum support. As a result, little or no physical exertion other than pushing the shoveling device across the area to be cleaned and pushing downwardly on the lever mechanism with one's body weight, preferably by the use of the large leg muscles rather than the relatively smaller arm muscles, is required. In addition, once the load is lifted, such load is easily released from the shoveling blade again with only minimal physical strain or exertion when compared to the large strain on the heart and muscles in shoveling using a regular hand shovel. Even more important in the present invention, however, is that instead of the weight of the snow or other congealed precipitation being supported during lifting by the articulated cervical column of the shoveler of the snow, the weight of the snow is supported by the much more durable and damage resistant handle of the shovel which rests upon the underlying surface from which the snow is being removed during lifting and the downward force is applied as indicated to the leveraged shovel blade not by the relatively weak muscles of the arms, but by the considerably more powerful muscles of the legs or one leg, further removing, stress from the spine, since the legs of the human torso are articulated into the hips below the spine. The only stress to the spine, therefore, is the relatively low stress of maintaining the shovel handle upright upon the surface from which snow is being removed, and even this stress comprises only a relatively low sidewise force effective to maintain the shovel handle essentially upright. Furthermore, even this low stress can be partially alleviated by providing multiple point, such as four point, bottom contact of the shovel handle with ground surface. The actual dumping of snow from the shovel blade once it is elevated can be effected in several different ways, as will be explained, such as overbalancing of the shovel blade and the use of push rod means to rotate the blade.

3. Description of Related Art

As indicated above, various arrangements are known in the prior art which are designed to lessen the amount of work and physical exertion involved in lifting a load using a shovel. Many of these arrangements involve a use of fulcrumed load lifting. However, none of such arrangements of which the present inventor is aware involve the use of a handle which supports a lifting fulcrum against the support of the ground.

One common device is the addition of an auxiliary handle to a shovel normally having a single gripping area on the upper end of the regular handle. For example, U.S. Pat. No. 584,827 issued to B. F. McIndoo on Jun. 22, 1897, entitled "Shovel," is an early example of a shovel having an auxiliary handle pivotably connected to the lower end of the regular handle. To lift a load, the auxiliary handle is swung forwardly where it is held by a pawl and rack arrangement. When the load is ready to be pitched off the shovel blade, the pawl is disengaged from the rack and the auxiliary handle is allowed to naturally swing backwards toward the upper end of the regular handle. In U.S. Pat. No. 4,198,090 issued to D. Gutman on Apr. 15, 1980, also entitled "Shovel," teaches a shovel having an adjustable lever situated partway along the handle portion of the shovel and a secondary handle member connected to the upper handle portion of the shovel. Gutman also utilizes a lever mechanism to aid in initially lifting a load on the scoop member; however, considerable lifting and strain is still required to support and dump the load.

As another example, in U.S. Pat. No. 4,881,332 issued to G. L. Evertsen on Nov. 21, 1989, entitled "Shovel Lifting Aid," a shovel handle having a swivelable bar connected thereto and arranged so that when the user's foot is placed on the bar and the shovel blade is filled with a load, the load is lifted by pulling rearwardly on the handle until the load is essentially balanced on the lifting aid. Once lifted, the handle may be pivoted to the side to dump the load. A wheel arrangement as part of the lifting aid is also contemplated. In U.S. Pat. No. 5,440,828 issued to R. C. Simpson on Aug. 15, 1995, entitled "Manual Snow Removal Tool," a shovel in which the handle is pivotable to either side within a range of angular positions with respect to the blade is shown, which allows the shovel to be used both conventionally to scoop and then lift and throw a load of snow, or to windrow the snow when the handle is set at an oblique angle with respect to the blade.

A large number of shovels having fulcrum or pivot attachments are also well known. U.S. Pat. No. 738,057 issued to E. B. O'Connor on Sep. 1, 1903, entitled "Shovel Attachment," discloses a fulcrum type attachment for a shovel that acts as a rocker on which the shovel rests and rocks as the shovel is moved forward or rearward. Rocking of the shovel on the fulcrum eliminates the need to stoop to fill the shovel.

U.S. Pat. No. 2,734,291 issued to C. C. Lasker on Feb. 14, 1956, entitled "Manually Operated Snow Removal Tool," discloses a scoop or shovel having a pair of curved combination rocker and skids connected to the back of the shovel blade. In use the shovel blade is pushed over the surface to be cleaned, and then is tilted upwardly by pushing down on the handle so that the shovel blade is pivoted off the ground and is supported on the rocker and skids. The tool is then pushed to a dumping area on the skids and pivoted forwardly onto the front edge of the blade so that the snow will simply slide off the blade. While Lasker eliminates lifting of the loaded shovel, it may be difficult to dump the snow if more than a few inches has fallen since the blade is always at more or less ground level.

U.S. Pat. No. 2,769,612 issued to C. Weisheit on Nov. 6, 1956, entitled "Shovel With Lifting Means," discloses a shovel having attached both an auxiliary handle and a fulcrum or lever device. The fulcrum or lever is connected to the bottom side of the shovel handle via a plate member, while the pivotable handle is connected to the upper side of the shovel handle. A spring arrangement is also used to continually urge the shovel blade into contact with the ground. Pulling upwardly on auxiliary handle and pushing downwardly on the regular handle causes the shovel blade to pivot upwardly so it is balanced on the fulcrum or lever. Such system aids in the initial lifting process but still requires the user to support the entire weight of the load of snow prior to dumping.

U.S. Pat. No. 3,035,816 issued to M. A. Conant on May 22, 1962, entitled "Foot Lever for a Hand Shovel," discloses another lever device which when downward pressure is placed on the foot pedal, the lever rocks so that the loaded shovel blade is forced upwardly. If enough downward force is placed on the foot lever, the snow or load will continue moving in an upward direction and may then be easily deflected to the side by turning the shovel handle or blade.

U.S. Pat. No. 3,343,807 issued to A. L. Moraski on Sep. 26, 1967, entitled "Shovel," discloses an arrangement similar to that found in Lasker but with a pair of arcuate legs forming a fulcrum point for pivoting the shovel blade upwardly. In addition, a pair of roller wheels are provided to facilitate forward or rearward movement of the shovel.

U.S. Pat. No. 3,748,761 issued to C. H. Chetwynde on Jul. 31, 1973, entitled "Snow Handling Device," discloses a shoveling device having a wheeled carriage structure with an upwardly telescoping jack and front link having sleeves or couplings for receiving a shovel handle so that it may be rotated axially within a certain range. The jack acts as a fulcrum for lifting snow piled in the scoop by pressing downwardly on the other end of the shovel handle. The handle is then turned axially to dump the snow, which dumping height may be adjusted by changing the length of the telescoping jack.

U.S. Pat. No. 4,130,953 issued to A. T. Bruno on Dec. 26, 1978, entitled "Snow Jack," discloses another scoop or shovel pivotably mounted to a lever arm mounted on a pedestal connected to a sled or base. The scoop is pivotable in either a horizontal or vertical plane on the pedestal, while a release catch extending along the lever arm to the handle is used to release the scoop and dump the snow. After snow accumulates in the scoop the handle portion of the lever arm is pushed downwardly so that the scoop is lifted off the ground. The release is then actuated, causing the scoop to pivot downwardly on a hinge and release snow in the scoop.

U.S. Pat. No. 5,074,064 issued to J. G. Nickels on Dec. 24, 1991, entitled "Snow Shovel," discloses a shovel wherein a snow ejection plate forms the bottom wall of the shovel which when swung from a prone to an upright position by pulling upwardly on a hand grip forces snow out of or off of the shovel blade.

In U.S. Pat. No. 5,669,651 issued to A. Vroegindewey on Sep. 23, 1997, entitled "Shovel With Lift Aid Attachment," a cambered foot pedal attachment is pivotably connected extending rearwardly from the lower end of the handle shaft which when stepped on by the user urges the shovel blade to be raised upwardly by lever action. Also, an auxiliary handle on the forward end of the lever is used to help throw snow off of the shovel blade. At some point, however, the full weight of snow still must be supported by the user.

In U.S. Pat. No. 5,732,933 issued to F. K. Champi on Mar. 31, 1998, entitled "Lifting Implement," another cambered foot actuated lifting aid attachment for a conventional snow shovel is disclosed. Champi is conceptually similar to the Vroegindewey lifting aid, although it does not include an auxiliary handle, with the lifting aid pivotably connected to the shovel handle by a hinge clamp having a spring therein. A hook is also provided to hold the attachment close to the shovel handle when not in use.

U.S. Pat. No. 6,086,049 issued to D. A. Sheils on Jul. 11, 2000, entitled "Mechanical Assistance Mechanism for Shovels," discloses another lever-type ground engaging rod connected to a shovel shaft near the shovel blade. The Sheils shovel is also pivotable to the side while being supported on the rod to facilitate dumping of the load.

U.S. Pat. No. 6,203,081 issued to E. B. Kegan, Sr. on Mar. 20, 2001, entitled "Easy Lift Levered Shovel," discloses another shovel having a lever attachment including a spring arrangement for automatically pivoting the lever legs so that they are adjacent to the shovel handle shaft when there is no load on the shovel handle. Dumping of the snow or load is accomplished by lifting the shovel handle and flinging the snow to the side in the usual manner.

U.S. Pat. No. 6,485,076 issued to W. N. Chang on Nov. 26, 2002, entitled "Versatile Attachment for Shovel," discloses a pivotable angled rod that may be used both as a handle and a foot engaged lifting lever. The Chang attachment may also slide along the ground to aid in transporting snow to a suitable dumping area. Structurally, such arrangement is different from the present invention, however.

Combination shovels and pusher arrangements or plows are also known in the prior art. For example, U.S. Pat. No. 2,239,297 issued to S. E. Allen et al. on Apr. 22, 1941, entitled "Snow Shovel," discloses a device that may be used either as a shovel or plow-type device by adjusting the angle of the handle in relation to the shovel blade. A wing-nut is used to secure the blade and handle at the desired angle.

U.S. Pat. No. 4,531,713 issued to F. H. Balboni on Jul. 30, 1985, entitled "Snow Removal Implement," discloses an implement having a wide rectangular blade, a U-shaped handle, and a pivot or fulcrum member, designed to be pushed across a snow-filled area, with the blade being pivotable upwardly by applying a downward force on the handle, causing snow to be flipped or tossed off the blade. No means for pivoting or releasing the blade after it has been moved to a raised position is shown, nor is a foot lever used to aid in raising the blade off the ground.

U.S. DES. PAT. 275,928 issued to D. R. LoPresti on Oct. 16, 1984, entitled "Levered Shovel Unit," discloses an ornamental design for another shovel having a lever or fulcrum arrangement similar to those described above.

Push-type wheeled snow shovels or scoops are also commonly found in the prior art. U.S. Pat. No. 3,043,033 issued to H. O. Ingram et al. on Jul. 10, 1962, entitled "Utility Scoop," discloses an adjustable wheeled manual scoop device having a releasable scoop adjusting assembly having a toothed rack portion and a releasable spring locking arrangement that is actuated by a lever situated near the handle of the scoop. When the lever is pressed a detent is released from the toothed rack, and the angle of the scoop in relation to the handle and wheel assembly can be adjusted to facilitate scooping, carrying and dumping of debris.

U.S. Pat. No. 3,121,963 issued to C. W. Nolan on Feb. 25, 1964, entitled "Shoveling Device," discloses another wheeled shovel having an independently pivotable subframe including a snow scoop. After the scoop is loaded with snow, it is pivoted upwardly to a horizontal position and is held by a latch member. A chain connected to the rear wall section of the scoop is then pulled, causing such wall section to retract and allowing the load of snow to essentially drop out of the scoop at a dumping location. A counterweight is provided to minimize the physical exertion in pivoting the loaded scoop. The angle of the handle in relation to the scoop makes it impractical or difficult to advance the Nolan device forward along an elongated surface such as the width of a driveway or the like.

U.S. Pat. No. 3,923,331 issued to A. A. Hollnagel on Dec. 2, 1975, entitled "Snow Scoop," discloses a bucket-type snow scoop designed to be pushed across the ground on a convex ground engaging surface on the bottom side of the scoop as well as runners on a curved frame structure. The scoop is pivotally connected to the frame via a pair of mounting arms. After it is loaded with snow, the bucket is pivoted upwardly by pressing downwardly on the frame handles. A latch may then be released to allow the bucket to pivot forwardly to a dumping position.

U.S. Pat. No. 4,125,951 issued to A. W. Huerth on Nov. 21, 1978, entitled "Snow Removal Device," discloses another snow scoop or pusher wherein a main body member is connected to a shovel blade portion having raised side walls, plus a handle means. Snow is piled up in the device by pushing it forwardly along the ground with the handle, while the snow is removed from the blade by rapidly decelerating the blade so that the snow is thrown forward. The Huerth device is thus an example of a device designed especially for using accumulated momentum along a surface to propel snow to a specific resting location on such surface.

U.S. Pat. No. 5,018,282 issued to K. Y. Hong on May 28, 1991, entitled "Mechanical Shovel," discloses a wheeled shovel or snow scoop also having a lever mechanism for emptying the scoop. When downward foot pressure is applied to a bight connected to the lever arm, the scoop slants rearwardly on a pair of gudgeon pins secured in slots on the chassis, and snow is moved to the rear of the scoop. Snow is dumped from the scoop when further pressure is applied to the lever, so that the scoop is angled upwardly and forwardly.

U.S. Pat. No. 5,271,169 issued to K. J. Konsztowicz on Dec. 21, 1993, entitled "Snow Shovel/Pusher," discloses a combination/convertible snow shovel and plow having a snow pushing blade having a curled-under end so that the blade does not dig into the surface being cleared, which may be a rough or loose stone surface. A handle assembly for pushing the blade on a pair of ski-like runners is provided. No means for lifting or more easily dumping snow from the blade is shown.

U.S. Pat. No. 5,511,327 issued to M. G. Jurkowski et al. on Apr. 30, 1996, entitled "Wheeled Snow Shovelling Device," discloses a cart-like structure for holding a snow shovel or plow having a large centrally located wheel. The cart may be used as a pivot device to lift the shovel blade, and the cart may be tilted on the large wheel to the side to dump snow on an area adjacent to the area to be cleaned. However, Jurkowski indicates that such shoveling device is effective only in rather light snow accumulations of up to approximately 3 inches.

U.S. Pat. No. 5,918,921 issued to V. Samuelson on Jul. 6, 1999, entitled "Levered Shovel for Moving Snow," discloses a shovel having a wheel assembly connected to approximately the center of the handle shaft of a shovel, which wheel acts as a fulcrum for the shovel.

U.S. Pat. No. 5,984,393 issued to R. H. Washington on Nov. 16, 1999, entitled "Shovel With Pivoting Head," discloses a shovel and handle assembly wherein the shovel and handle shaft are joined together by a pivot joint so that the shovel head can rotate around a longitudinal axis with respect to the handle shaft in either a clockwise or counter-clockwise direction. Such shovel design reduces the stress caused by the act of turning or twisting and dumping the contents of the shovel, rather than bending and lifting the load. No aid for lifting the load is provided, however, so that a significant amount of bending and lifting is still required.

U.S. Pat. No. 6,053,548 issued to L. G. Bowles, Jr. on Apr. 25, 2000, entitled "Manually-Operable Combination Shovel and Plow for Snow and Other Material," discloses a shovel wherein the shovel blade is positionable at various fixed angles with respect to the handle. A male and female joint member securable together by pins connects the shovel blade and handle so that the blade may be placed at an angle which is convenient for plowing, rather than shoveling. A toothed and notched opening is provided in the male joint member which allows the blade to be secured at one of three angles or positions with respect to the handle, where it is held by a spring arrangement. When the handle is pulled back or rearwardly, the pins disengage so that the angle of the shovel blade can be adjusted. An auxiliary handle bar is also provided on the main handle to facilitate plowing, and in addition a wheel assembly may be added to the shovel to make plowing even easier.

U.S. Pat. No. 6,457,757 issued to J. D. Hendrick on Oct. 1, 2002, entitled "Snow Shoveling Apparatus With Handle and Blade Adjustable During Movement of Apparatus," discloses a wheeled shovel wherein the angle of the handle and the blade are adjustable on notched mounting plates. Handle angle and blade angle adjustment levers are also provided so that the settings can be changed during use of the shovel. No additional means for lifting or dumping the snow are disclosed.

While there are obviously, therefore, a large number of shovels having a variety of lifting or dumping aids connectable thereto, each of which is useful for its own purposes, the present inventor's shoveling tool according to this invention substantially departs from the conventional concepts and designs of the prior art, and in doing so provides an apparatus wherein strain and exertion from both lifting and dumping a heavy load of snow is essentially eliminated. Therefore, since none of the prior art arrangements provides a snow lifting and dumping arrangement in accordance with the teachings of the present inventor's device, it can be appreciated that there exists a need for such a device which is both significantly less expensive than a snow blower, but also is more easily used and safer to use from a physiological standpoint than a conventional snow shovel. In this regard, therefore, the present invention substantially fulfills a significant existing need.

OBJECTS OF THE INVENTION

It is therefore a primary object of the invention to provide a manually operable snow removal device that eliminates much of both the indirect and direct muscular exertion and strain associated with conventional shoveling devices.

It is a further object of the present invention to provide a snow removal device that may be used to easily manually push or plow quantities of snow on a surface onto a snow pusher blade and then to lift such snow and deposite it in a desired location.

It is a still further object of the present invention to provide a shoveling device having a foot activated lever mechanism which eliminates much of the strain and stress associated with lifting a conventional loaded shovel blade.

It is a still further object of the present invention to provide a shoveling device wherein snow may be lifted using such shoveling device, and then such snow may be dumped or released from the shovel blade without any further significant physical exertion by the user.

It is a still further object of the invention to provide a shoveling device in which the material being shoveled may be either initially plowed or shoveled to a small height and then after the lower portion of the handle is placed on the ground lifted without significant arm lifting exertion to a height suitable to deposite it in a disposal area.

It is a still further object of the invention to provide a snow removal shovel-type device having an extended shovel handle having a lower end adapted for resting upon the ground or other surface to support a load of snow while the snow is lifted by foot pressure upon a lever means upon the shovel prior to dumping.

It is a still further object of the invention to provide a snow removal and transport device having a handle with an indirectly attached shovel blade adapted for passage across a ground or other support surface on a ground passage facilitating means plus a surface stabilization surface upon which the shovel device is supported as the load is lifted by a shovel blade and deposited in a disposal area.

It is a still further object of the invention to provide a snow removal device which essentially eliminates arm lifting exertion and substitutes therefore leg depression in a semi-stepping motion to elevate the snow prior to depositing it in a snow disposal area.

It is a still further object of the invention to provide a snow removal apparatus which supports gathered snow on a ground engaging solid support while transferring the snow from the device to a snow deposite area by foot manipulation.

It is a still further object of the invention to provide a hand snow removal device which substitutes a rigid support means for support of a load of snow for the usual support by the human spine structure and substitutes downward leg motion for arm lifting motion to transfer the snow to a disposal area.

It is a still further object of the invention to provide a snow removal device that can be constructed in various manners with single or multiple handle members and pivoting members.

It is a still further object of the invention to provide a snow removal device in which the snow can be either actively removed from the shovel blade by forcefully or actively pivoting the blade to cause snow to be dropped therefrom or can be passively allowed to pivot down to eject snow therefrom.

It is a still further general object of the invention to provide a snow removal device which substitutes a sturdy physical support for support of a load of snow for or in place of the spine or vertebral column of a snow shoveler plus substitutes the muscles of the legs to lift such snow for or in place of the arms of the shoveler.

It is a still further object of the invention to provide a manually operated snow removal device which effectively substitutes support by the handle or principal support member of the snow removal device for support of the load by the vertebral column of the shoveler and the downward force of the shoveler's leg for lifting of the load by the arms of the shoveler.

It is a still further object of the invention to provide a snow shovel device incorporating a load support directly in contact with the ground during lifting of the load that serves as a handle for the shovel blade during collection of snow upon the blade.

It is a still further object of the invention to provide a mechanically aided handle mechanism or arrangement for a shovel blade which can be substituted for by a more conventional handle rendering the shovel blade usable as a conventional shovel as well as a mechanically aided shovel.

Still other objects and advantages of the invention will become clear upon review of the following detailed description in conjunction with the appended drawings.

SUMMARY OF THE INVENTION

An improved shovel type snow removal device is provided in which during lifting of the snow after a plowing motion during which snow is gathered on the shovel blade, the shovel handle is supported upon the ground instead of on or by the spinal structure of the shoveler and lifting force upon the shovel blade is provided by downward leg force, supplemented preferably by a forward leg force, exerted upon a lever system to which the shovel blade is attached for manipulation. The device is formed from a more or less conventional shovel blade mounted upon a pivoting lever and preferably provided with a second manipulating rod adapted to be forced forward by foot or leg pressure to tilt the blade in order to dump a load of snow from the blade or simply by partially unlocking the blade from the handle allowing it to downwardly rotate to dump snow accumulated upon it. By supporting the shovel on the end of its handle collecting snow and on the end of a lever when lifting snow and manipulating the shovel blade by foot and leg action mediated by a lever system a user is enabled to clear an area of snow and deposite the cleared snow in a disposal area without placing any significant strain on the user's vertebral column or arms. The shoveling device of the invention may for sturdiness and balance be constructed with either multiple or single or unitary handle and lever systems.

BRIEF DESCRIPTION OF THE DRAWINGS

The following are drawings of several possible embodiments of the invention:

FIG. 14 is a disassembled or broken apart view and FIG. 15 is a manufacturing parts list keyed to the individual parts shown in FIG. 14 of the separate parts of the shovel of the invention ready for assembly.

DESCRIPTION OF THE PREFERRED EMBODIMENTS

Figure 1:
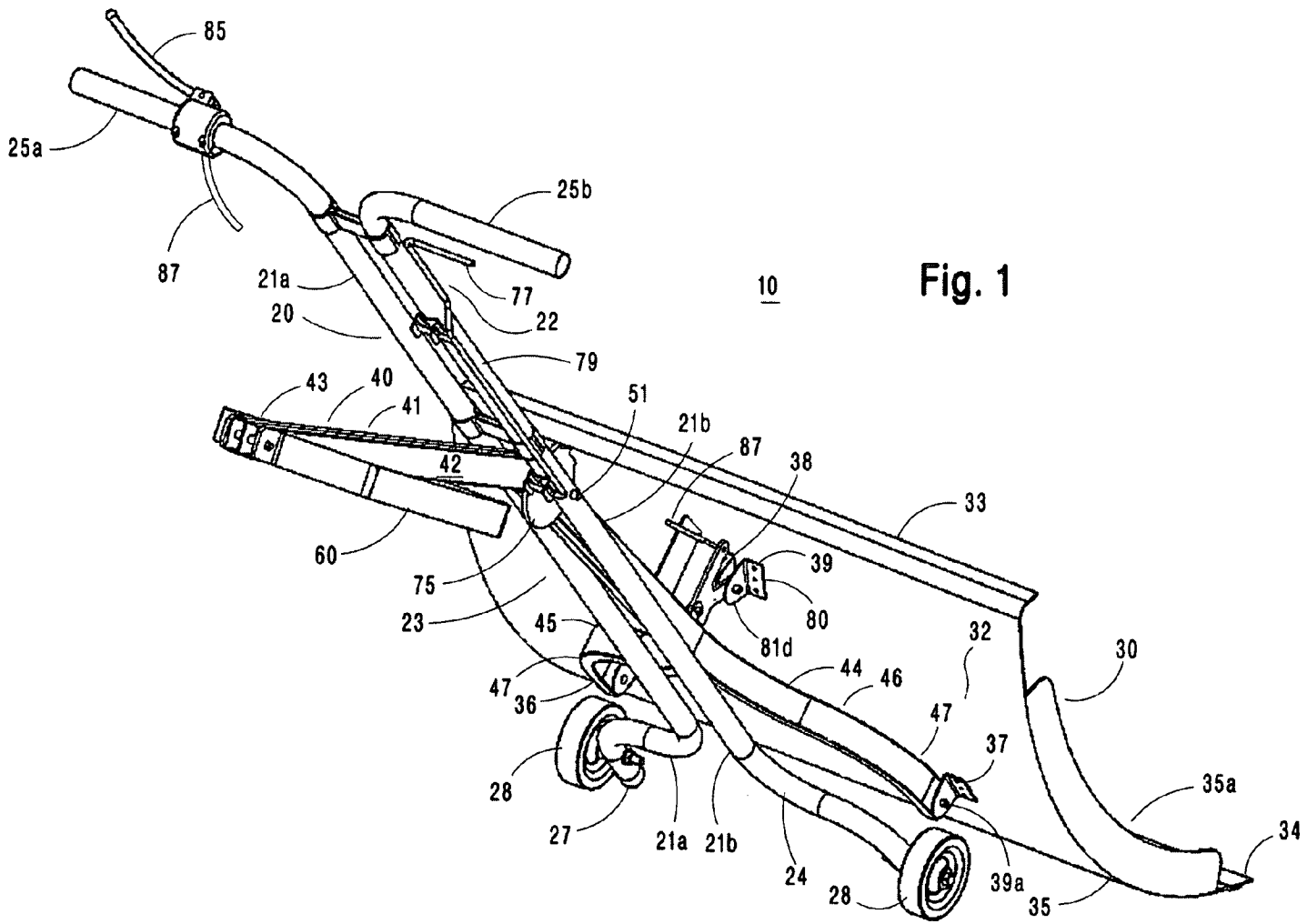
FIG. 1 is an isometric view from the upper right rear quadrant of a presently preferred embodiment of the snow shovel of the invention in plowing or collecting configuration.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

It is standard practice in the removal of congealed precipitation whether in the form of snow, sleet, hail or the like, the most prevalent form normally handled being snow, to either push or plow such congealed precipitation, or snow, from the location where it is not desired to a disposal location or alternatively to lift or shovel the snow from the place where it is not desired to a disposal location. While pushing or plowing snow and the like generally places the least strain upon the person carrying out such pushing or plowing operation, accumulated snow in the disposal area quickly blocks further horizontal movement of such accumulated precipitation, particularly in the case of so called "wet snow," which quickly packs into a heavy semi-consolidated mass. Consequently, unless the snow is lifted and deposited on top of the previous accumulation, placement of snow in the disposal area quickly reaches a substantial saturation point. On the other hand, if the snow is lifted by a shovel or the like, it can be consecutively placed upon the top of earlier accumulations considerably increasing the capacity of such disposal areas or locations. Shoveling or physically lifting snow and other similar accumulations and depositing it on top of previous accumulations means not only that considerable stress is applied to the components of the third class lever system that makes up the arm and hand while grasping the handle of a shovel or the like and lifting, i.e. with the force or lifting effort positioned between the fulcrum constituted by the elbow and the weight grasped by the hand. Alternatively, the snow on the blade of a shovel may be lifted by the first class lever system constituted by the hand grasping a midpoint of the shovel handle with the weight on the blade of the shovel on one side of the hand and the force applied to the handle in a downward direction on the other side of the fulcrum constituted by the supporting hand, the leverage being whatever the differential in length of handle sections is on either side of the supporting hand. In most lifting of snow on a shovel, the lever system involved is in effect a double system in which one hand lifts at the fulcrum, i.e. a third class lever system and the other hand pushes down on the opposite end of the shovel at the handle, i.e. a first class lever system. As the weight becomes greater, or the muscles on the supporting arm become more tired, the third class lever lifting is allowed to decline and more effort is applied by means of the first class lever arrangement represented by the hand grasping the shovel handle at a midpoint and the opposite hand pushing down on the shovel handle at the opposite end from the shovel blade. Whatever the lever system being used, however, the entire weight of the snow is effectively upon the spinal column of the shoveler, plus concentrated on one side of the shoveler, tending not only to force the spinal column downwardly and compressing the discs between the vertebrae not only overall, but tending to compress the discs more on one side than on the other so that the tendency is for the spinal disc to tend to be squeezed or extruded out from between the discs towards the less compressed side. It is not at all rare in such circumstances for the disc to be either ruptured or displaced toward one side, or both, with frequently excruciating pain as the disc material presses against the nerves of the spinal column either generally or against nerves passing between vertebrae to the rest of the body. While the young supple body is frequently able to withstand these unequal or lopsided strains placed upon the vertebral column, as the human body ages it is able to withstand the intermittent stresses and strains of shoveling to a lesser and lesser degree, although dependent somewhat upon how healthy the individual tends to be, the earlier injuries such individual has sustained and what physical conditions he or she maintains from day to day. Not only is the weight of a shovel of snow distributed unevenly to the vertebral column of the shoveler, but in placing it in the intended deposit area the vertebral column is frequently subjected to a twisting motion as the body is swung to deposit the load to one side or the other.

The present inventor in considering the problems in shoveling snow has realized that what is needed is a snow removal or shoveling device that places a minimum stress not only upon the arms of the shoveler, but also upon the vertebral column of the shoveler. The inventor has, therefore, designed a snow removal device which first directly supports the weight of a shovel-full of snow not on the vertebral column of the shoveler, but upon the handle of the shovel, which rests during the lifting phase of shoveling not upon or passing through the shoveler's vertebral column, but upon the ground or other support upon which the shoveler stands. Secondly, the weight of the snow on the end of the shovel is not lifted by the relatively weak arm muscles of the shoveler, but instead by a downward or principally downward force of the leg muscles. The legs contain, in the normal human body, the largest muscles and are usually the potion of the skeletal-muscular system which is kept in best physical condition as the result of the necessary walking and support of the body which the legs carry out in those who are not disabled in some manner.

In addition, the removal of snow is designed in the present invention to be accomplished principally by a plowing motion which scrapes or pushes the shovel blade along the ground, piling up snow both in front of the blade and upon it, after which the snow may be lifted by a fulcrumed or pivoting movement, force being applied to the end of the fulcrum or pivot arm by the foot and leg of the shoveler while the shovel itself is supported upon the ground or other support surface. While the shovel blade is pivoted upward by the action of the foot and leg, or one foot and leg of the shoveler, the stance of the shoveler is not unbalanced by the use of one leg to lift the snow on the shovel (by a downward movement of the leg which is the most powerful movement of the leg because of the normal support functions of the leg) because the shoveler standing upon one leg is balanced by simultaneous resting of the shovel handle upon the ground.

If it is desired to move the shovel while supporting the end of the handle upon the ground, the end of the handle is preferably supplied with slide means such as small sled-type runners or more preferably by small wheels placed so that by adjusting the angles of the handle with respect to upright, it can be rested directly and essentially immovably upon the ground or can be adjusted in angle so that runners or slides or more preferably small wheels can be supported upon the ground or other support surface enabling the entire shovel structure to be moved bodily along the surface.

The snow removal device or improved shovel apparatus of the invention can be constructed in various ways and in various embodiments. For example, the handle of the device, which handle may be curved to facilitate both placement upon the ground for support and control while moving may be in single column form or multiple or plural column form. Likewise, the pivot or fulcrum arm or arms to which the blade is attached, which arms are pivotally attached to the handle, may be single or multiple. However, since the shovel blade is often desirably larger than a normal shovel blade, because it is preferably used primarily in a plow mode and when lifted can support larger loads of snow because it is lifted by the legs rather than the relatively weaker arms, it is often preferred that the pivot or fulcrum arm also be of multiple member construction to provide better balance, it being relatively difficult to prevent a single pivot arm from twisting when supporting a large unbalanced load on a wide shovel blade. Various pivots and pivoting arrangements can be used and the shovel blade is preferably in the form of the usual curved rectangular blade. In fact, in one embodiment of the invention, when desired by the owner, the shovel blade can be disconnected from the normal mechanical and support arm arrangement of the invention and connected to a more conventional handle for more conventional use.

In the preferred version of the snow removal apparatus of the invention, the shovel is not only provided with a pivot arm supporting the shovel blade, but the shovel blade is pivoted more or less centrally upon the end of the pivot arm in such a manner that the blade may be either held more or less rigidly upon the pivot arm or allowed to pivot from a more or less horizontal position to a vertical position or even more than a vertical position to dump or discharge snow from the blade into a deposit area. In the simplest version of such embodiment, the shovel blade is provided with a locking arrangement that holds it rigid on the pivot arm or arms when gathering snow or in shoveling or plowing mode, but is disconnectable or unlockable when the blade is brought over a snow deposit area, whereupon the blade is unlocked and because of its pivot point will rotate into a vertical or more than vertical position and dump its snow from it into the deposit area, whereupon the shovel blade may be pushed or kicked up into a locked position again and moved to gather another load of snow.

In another version of the invention, the blade angle will be actively or positively controlled by an angled push rod or control rod arrangement by which the foot of the user may be used simultaneously or consecutively to both pivot the blade upwardly to lift a load of snow, but also when desired to dump such accumulated snow from the blade to rotate the blade forwardly to dump the snow from it. In this version or embodiment of the invention, the push rod or angle control rod may be preferably slidably attached to the handle and/or pivot rod by a sliding connection such as a slide groove in the angle control rod and/or in the handle. Such sliding connection must usually be a four way or multiple slide connection, i.e. it must not only slide forwardly and backwardly, but also up and down in any direction, because as the slide rod moves the geometry of the mechanical system continuously changes as movement occurs. Alternatively, as shown, the push rod may be unsupported except at its two ends. A foot pedal or push rod arranged so that when the foot pedal is turned down or pivoted down, the push rod which is connected to an outer point of the pedal is pushed forwardly forcing the top of the blade forwardly and the entire blade into a more vertical position to dump snow from the blade. Spring means may be provided to return the foot pedal and blade to normal position when the user's foot releases pressure upon the foot pedal.

In a further embodiment, a suspended foot contact bar may be provided for contact by the foot of the operator. Downward force by the foot of the operator upon the foot bar will pivot the shovel blade upwardly and forward force by the foot will move the push rod forward to move the top of the blade outwardly and dump snow from it. In a further embodiment of the invention, the shovel blade pivot rod will be pivoted up by downward pressure or force upon the inner end by the foot while a separate push rod may be used to push out the top of the blade and dump the snow. Such push rod may be activated by the hand of the shoveler.

In each of the above instances or arrangements for dumping snow from the blade, once accumulated upon the blade, the weight of the snow or other congealed precipitation is supported by the end of the shovel blade handle resting upon the ground, thus removing compressive stress normally upon the spine of the shoveler from the spine to the shovel handle, while the stress of actually lifting the shovel blade with a load of snow is provided by a downward force on one foot utilizing the strong muscles of the leg rather than the relatively weak muscles of the arms. The only stress upon the arms and spine of the user occurs during actual horizontal movement of the shovel with a plowing action when the arms of the user partially support the handle of the shovel at an angle and force the shovel blade sidewise into the snow preparatory to movement to the disposal area partially supported by the arms, but mostly supported by small runners, skids, or wheels at the bottom of the handle. When the shovel reaches the disposal area the handle of the shovel is pivoted upwardly in position and the foot is used to actually lift the snow. A relatively young vigorous shoveler may sometimes actually carry the shovel with a load of snow from the point being shoveled a short distance to the disposal area or possibly pivot his or her body to the disposal area while supporting the load. However, such shoveler then, after placing the lower end of the shovel handle firmly upon the ground surface, will apply downward movement of the foot to the pivot arm to lift the snow and deposit it in the disposal area. In this way, while the arms and spine of the shoveler are stressed during carrying or movement of the load of snow to the disposal area, the more vigorous or stressful lifting of the load to deposit it upon other accumulated snow in the disposal area is avoided. In other instances, in the case of less vigorous shovelers for which the shovel is particularly designed the snow load will never be placed upon or applied in compression to the back, or spine, of the shoveler at all.

FIGS. 1 through 7 illustrate a first preferred embodiment of the invention, FIGS. 8 through 11 illustrate alternative embodiments, FIGS. 12 through 15 illustrate another alternative embodiment that enables the shovel blade used in the invention to be converted to more traditional use, and FIGS. 16–23 illustrate further alternative embodiments. Referring first to FIGS. 1 through 7, the numeral 10 generally represents the snow removal device of the invention. In its most basic form, device 10 is comprised of an elongated double support shaft 20, or handle, which serves as a combination handle and ground-engaging fulcrum, material handling blade or scoop 30, and foot activated lever or lifting mechanism 40.

Figure 6:
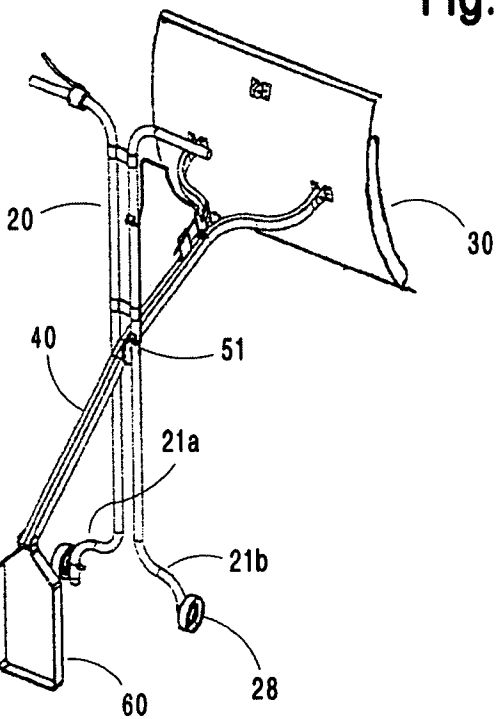
FIG. 6 is a reduced scale isometric view of the snow shovel of the invention with the shovel blade unlocked and rotated into dumping position.
Figure 4:
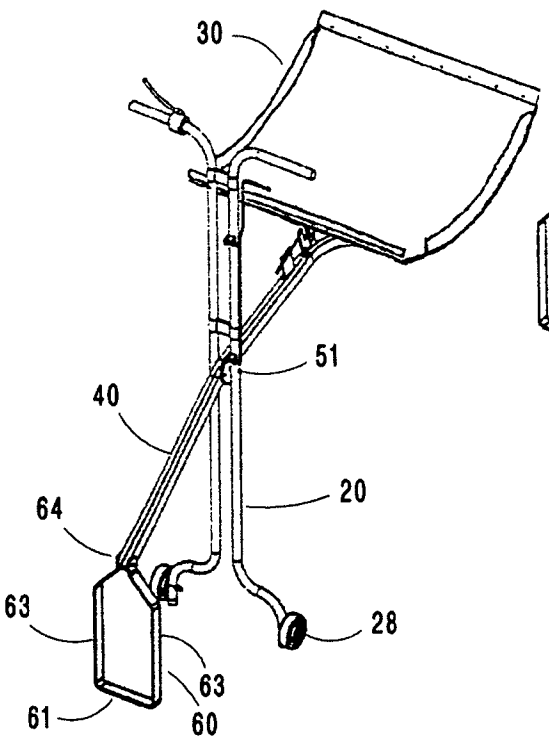
FIG. 4 is a reduced scale isometric drawing of the snow shovel of the invention with the shovel blade locked and lifted to maximum lift height.
Figure 5:
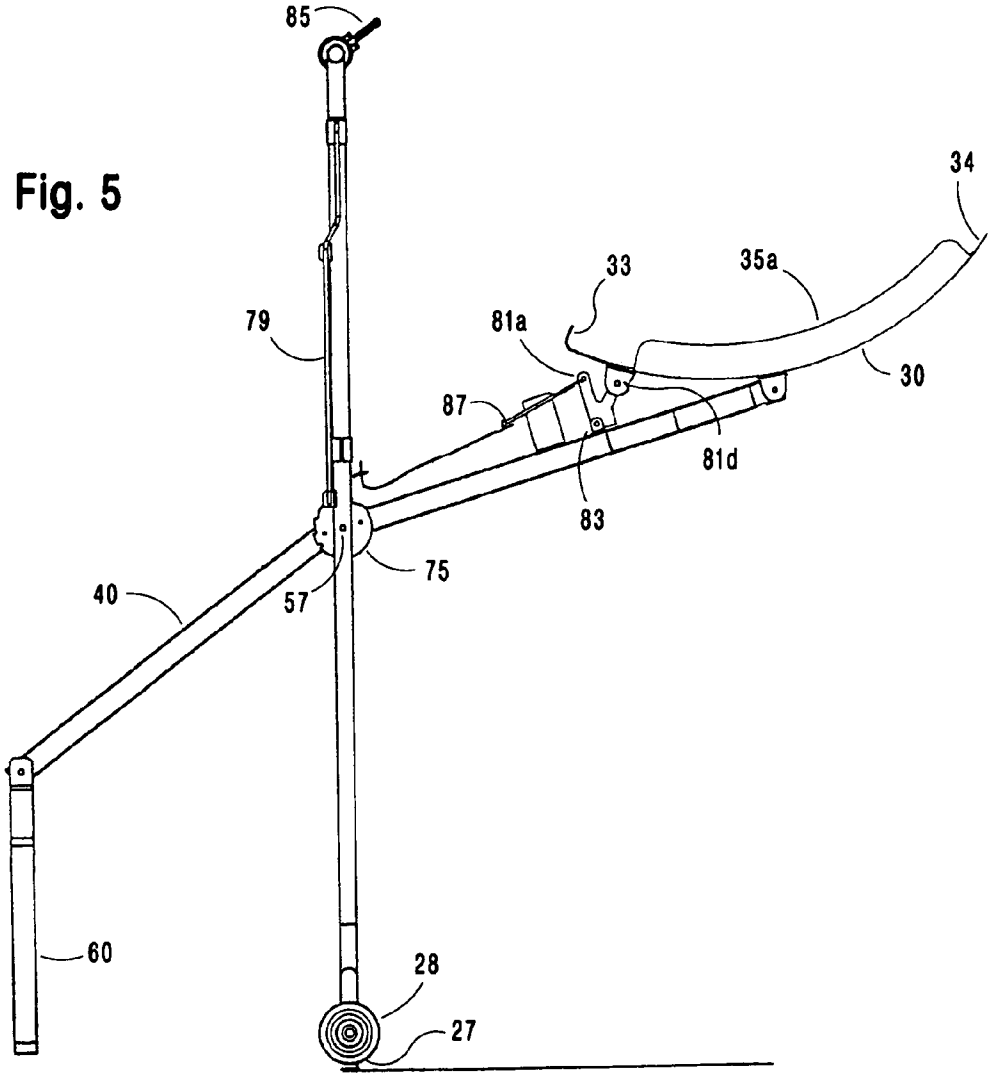
FIG. 5 is a side elevation of the snow shovel of the invention with the blade in the position shown in FIG. 4.

Referring more specifically now to FIG. 1, in the presently described embodiment of the elongated support shaft 20 such shaft is bifurcated and as such is comprised of first and second shaft sections 21*a* and 21*b*, which sections are substantially mirror images of each other. First and second shaft sections 21*a* and 21*b* each have an elongated upper shaft portion 22, a central portion 23, and a lower shaft portion 24. Upper shaft portion 22 is generally straight along its entire length, while central portion 23 is also straight but could be cambered downwardly somewhat towards the ground surface so that lower shaft portion 24 would be substantially perpendicular to such ground surface as shown in the embodiments depicted in FIGS. 8 and 9. Transverse handle grip members 25*a* and 25*b* are connected to the upper ends of shaft sections 21*a* and 21*b*, although alternatively and possibly preferably such handle grip members 25*a* and 25*b* are formed integrally with shaft 20. Handle grip members 25*a* and 25*b* are of course used to handle and maneuver the snow removal device 10 as described in more detail below. Shaft sections 21*a* and 21*b* are preferably tubular and made from a strong yet lightweight metal material such as aluminum. As shown in FIGS. 1, 4, and 6, lower portions 24 of first and second sections 21*a* and 21*b* curve outwardly and then downwardly so that a solid base for pivoting and lifting the shovel blade as described below results. Ground-engaging end pieces 27 preferably made from a non-skid material such as rubber may be attached to the ends of lower shaft portions 24 to prevent the device 10 from slipping during lifting of the shovel blade 30. When device 10 is in position for shoveling, end pieces 27 should be situated a few inches or fractions of an inch off the ground so that shaft 20 normally will not contact the ground and interrupt the pushing or shoveling movement but will glide supported on wheels 28, which, as mentioned above, could be replaced by skids or runners. In addition, while shaft 20 is described above as being comprised of two sections 21*a* and 21*b*, it should be understood that shaft 20 could be comprised of a single shaft section. More rigidity with less weight will usually be obtained from use of a double or multiple construction, however.

Figure 2:
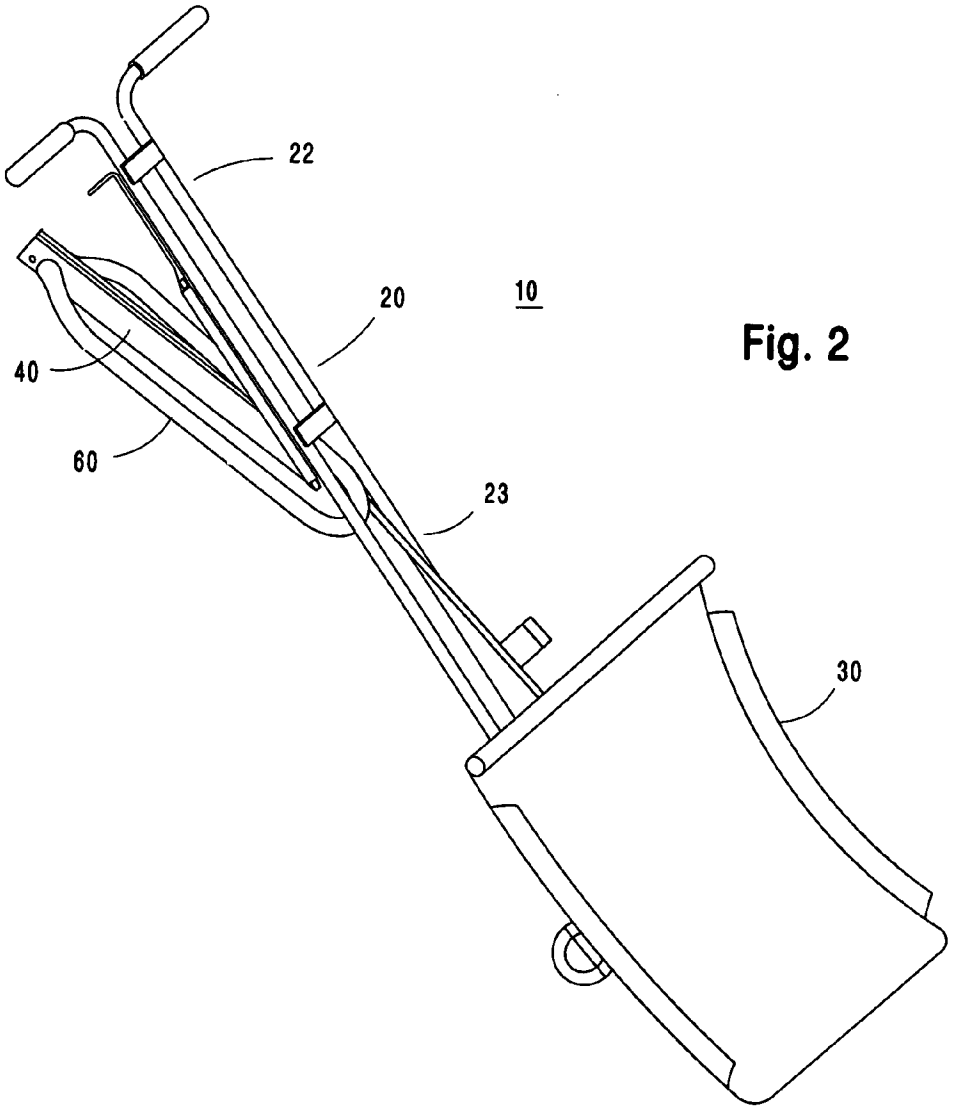
FIG. 2 is an isometric view from the upper right forward quadrant of the embodiment shown in FIG. 1 in collecting configuration.

The blade 30 used with the snow removal device 10 of the present invention is preferably molded out of a durable plastic such as PVC, although any other suitable material such as steel, or aluminum or an aluminum and/or magnesium alloy may also be used. Blade 30, best shown in FIGS. 1 and 2, is preferably generally rectangular in plane and slightly or somewhat curved in cross-section, and includes front and rear sides 31 and 32, top edge 33, ground engaging lower edge 34, and side edges 35. Although blade 30 may be in various sizes, in one embodiment blade 30 has a width of approximately thirty-two inches and a height of approximately twenty-four inches. Lower edge 34 may also be slightly curved or concave if desired, and blade 30 may also have shallow or low side walls 35*a* or be somewhat more cup or scoop-shaped to prevent material from slipping off sides of the blade during filling or lifting of the blade as described below.

Figure 7:
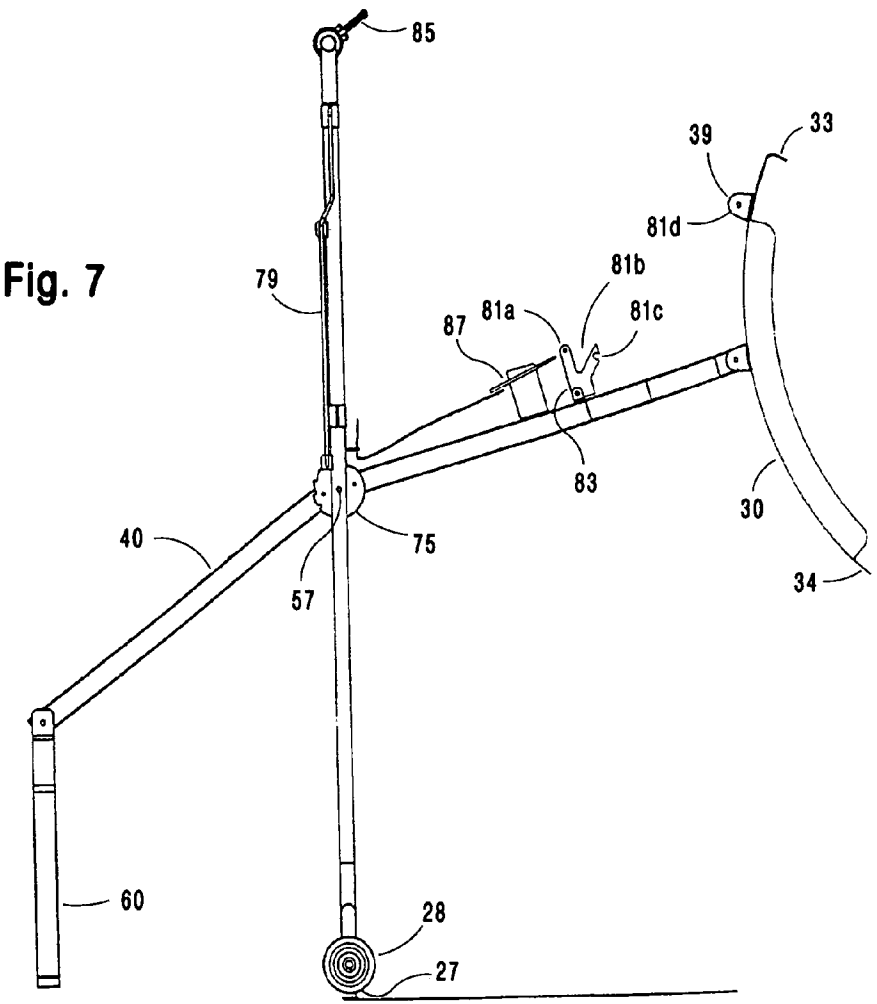
FIG. 7 is a side view with the blade of the shovel in the position shown in FIG. 6.

As best shown particularly in FIGS. 1 and 7, mounted to rear side 32 of blade 30 are pairs of frame pieces or bracket members 36–37 and 38–39 which pairs are spaced horizontally centrally from one another. Bracket members 36–37 and 38–39 are preferably integrally molded with blade 30 if the blade is of a plastic composition, although they may also be separately secured such as by rivets or bolts or welding, particularly if the blade is metallic, and serve as receiving members for pivotably connecting blade 30 directly to lever mechanism 40 and ultimately to handle shaft 20. In addition, blade 30 should be separable from lever mechanism 40 so that it may be replaced if necessary due to wear, or so that a slightly larger or smaller blade or a blade having a different curvature may be used if desired. As explained later, the blade 30 may also be separated from the mechanism of the invention and a conventional handle applied. The blade is secured to the pivot arm 40 by means of removable pivot or cotter pins 39*a*.

A preferred arrangement of lever mechanism 40 will now be described. Essentially, lever mechanism 40 is comprised of a pair of closely spaced parallel lever arms 41 and 42, a pair of outwardly splayed sections 45 and 46, and foot stirrup 60. Parallel lever arms 41 and 42 having upper ends 43 and lower ends 44 extend between the two sections 21*a* and 21*b* of shaft 20. The extreme lower ends 45 and 46 of lever arms 41 and 42 are preferably curved outwardly from shaft 20 and are pivotably connected to the rear side 32 of blade 30 in channel or bracket members 36 and 37 via pivot bolts or cotter pins 39*a*. The side walls of bracket members 36 and 37 prevent arms 41 and 42 from moving laterally with respect to blade 30. Arms 41 and 42 are also pivotably secured to shaft 20 at pivot 51 so that, as explained below, the central section 23 of shaft 20 rotates about a fulcrum with pivot 51 serving as such fulcrum or pivot point for lever mechanism 40 used in raising or lifting blade 30.

Figure 3:
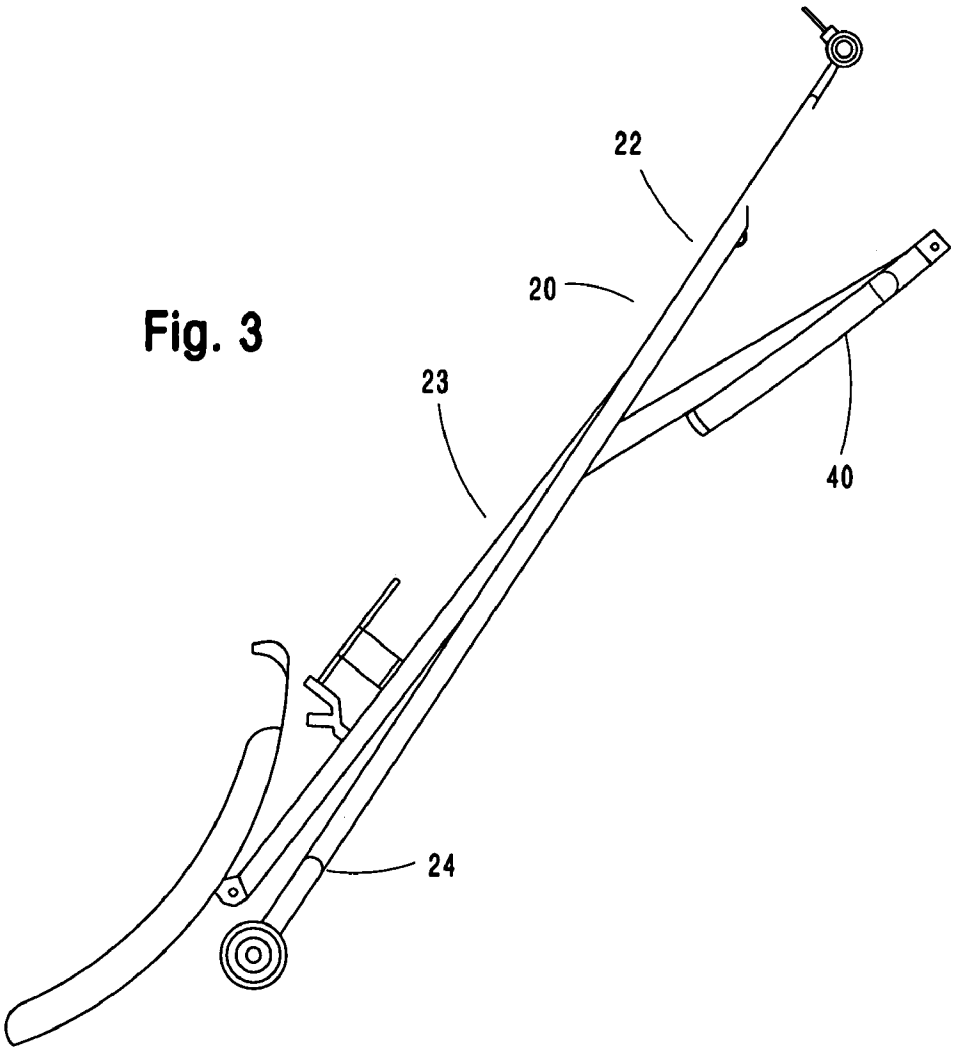
FIG. 3 is a side elevation of the snow shovel or plow of the invention in plowing position, but with the blade unlocked.

As shown best in FIGS. 4 and 6, foot engaging member or stirrup 60 serves as the actuating means for lever mechanism 40. Stirrup 60 as shown is generally rectangular in shape with a forwardly inclined upper end and is provided with a lower foot contacting surface or lower end 61, and substantially parallel side members 63*a* and 63*b* extending upwardly and then inwardly to upper end 62 where inclined pivot supports 64 pivotally connect stirrup 60 to the pivot arm 40. Stirrup 60 is shown in FIGS. 1, 2, and 3 folded upwardly against the pivot arm 40 where it will normally be out of the way during plowing or collection of snow with blade 30, while stirrup 60 is shown downwardly dependent in the position it will assume as the shovel is lifted and dumped from a raised position in FIGS. 4, 5, 6, and 7.

Upper ends 43 of arms 41 and 42 are pivotably connected to stirrup pedal 60 along upper end 64, while the outer ends 47 of the two sections 45 and 46 of pivot arm 40 are pivotably connected preferably to brackets 37.

The pivot arm 40 comprised of closely spaced arm sections 41 and 42 and diverging sections 45 and 46 is maintained ordinarily in a downward position by gravity and will be maintained in any raised position assumed or to which it is brought by ratchet wheel mechanism 75, which, however, can be released by operation of control arm 77 through rod or cable linkage 79. As a result of such ratchet linkage the blade 30 will normally rest upon the ground surface unless it is deliberately lifted at least one ratchet width by movement either of the pivot or fulcrum arm 40 or by riding over something on the ground which may lift the shovel blade at least one ratchet height. If it is desired to press the blade forcefully against the ground surface, the user can pull upwardly upon the end of the pivot arm 40 while, if necessary, disengaging the ratchet mechanism by operating or pulling the ratchet release handle 77. If the blade 30 is deliberately raised to lift a load of congealed precipitation, i.e. snow, the ratchet wheel mechanism will retain the blade at whatever position it is raised to. However, if it is desired to lower the pivot arm together with the shovel blade such as, for example, after snow has been dumped from the shovel blade, operation of the ratchet control arm 77 will through linkage 79 in a conventional manner release the ratchet mechanism 75 and allow the blade 30 to return to ground level or wherever the operator wishes to position it.

The shovel blade 30 is pivoted at brackets 36 and 37 such that more of the blade and any load supported upon it will be positioned in front of or beyond the brackets than behind such brackets. Thus, if the blade is not locked in place by the locking mechanism 80 it will be overweighted and will rotate to a vertical position dumping any snow accumulated upon it. The locking arrangement 80 shown in outline comprises a conventional spring loaded bifurcated rocking arm mechanism 81 having a first control arm 81*a* and a second locking arm 81*b* (see in particular FIG. 7) which are pivoted together on a base pivot 83. The bifurcated mechanism is pivoted on its base and spring biased toward the outer end of the pivot arm 40 so that the locking arm is normally interlocked through slot 81*c* with a pin 81*d* extending between bracket pieces 38 and 39 (see FIG. 1). So long as the rocker arm 81 is rocked forward with second locking arm 81*b* and slot 81*c* locked onto or over the pin 81*d* the shovel blade will be retained in the position shown in FIGS. 1, 3 and 4. However, by operation of locking lever 85 on the left handle 25*a* of the shovel a wire connection 87 between such lever and control arm 81*a* will retract locking ratchet mechanism arm 81*b* backward displacing the slot in locking arm 81*b* from over pin 81*d* and releasing blade 30 to rotate downwardly to dump any snow held upon such blade.

As previously generally described, operation of the snow removal device 10 to quickly clear snow, slush, or other granular or crystalline water material from a surface such as a sidewalk or driveway with a minimum amount of physical exertion and strain is more specifically as follows. The shovel or plow device 10 may be moved to the area to be cleaned by the user by pushing or pulling the device on wheels 28, which as described could be substituted by suitable runners or slides. Once in position, bottom edge 34 of blade 30 is placed in contact with the ground surface to be cleared or shoveled. The user, standing behind handle grip members 25*a–b*, grasps and pushes on such handles so that device 10 is moved forwardly in a plowing action with blade 30 in contact with the ground surface, causing snow and the like to be shoveled or transferred onto the front surface of the blade in the usual manner. An auxiliary wheel or pair of wheels may also be situated on the rear side of the blade to aid in moving the device across the ground surface, although this is not generally necessary. When sufficient frozen material has accumulated on blade 30, the user may then release foot stirrup 60 by rotating it downwardly away from pivot rod 40 and the foot of the shoveler may be placed in the stirrup and pressed down to force down the pivot rod 40 on the near side of the handle 20 and raise the two sections 45 and 46 of such pivot rod on the forward side of the handle lifting the shovel blade 30 along with it.

At this point, once the shovel blade is at least partially lifted by downward force to the inside of the stirrup 60 by the foot of the shoveler, the ratchet wheel 75 mechanism will serve to retain whatever height of the blade is attained and desirable and the shovel may be moved on its wheels 28 to the disposal area or, in other words, into disposal position, whether this be immediately adjacent to the removal zone or location or at a distance therefrom. Once committed to disposal, the shovel is moved to a position as close to the desired disposal position as possible and the shovel is preferably rocked forward so that the handle 20 is essentially vertical and supported upon the ground engaging end pieces 27 with the wheels 28 slightly off the supporting surface. Normally the pivot arm 40 will then be lifted at least somewhat higher over the disposal area and the hand lever 85 will be operated causing the thin cable 87 to apply tension through cable 87 retract locking arm 81*b* from locking pin 81*d* allowing the shovel blade to rotate from the weight of the snow and its own weight into the position shown in FIGS. 6 and 7 allowing the snow to slide off the shovel onto the disposal area. The shovel handle 20 may then be tilted again until the wheels 28 again rest on the ground and is thereupon moved back into shoveling position. When the ratchet lever 77 is operated the pivot rod is released allowing the shovel blade to rotate downwardly to reach the ground surface, the force of contact with which upon the lower edge of the blade will rotate the bottom of the shovel blade upwardly re-engaging the locking pin 81*d* with the locking lever 81*c*. The shovel can then be moved forward again to collect additional snow and the cycle repeated.

The sides 35*a* of the shovel blade aid in retaining snow on the blade until the blade is rotated down to dump the snow. If the ground surface should be uneven the sides prevent the snow from sliding off the side of the blade due to slight tipping of the shovel.

As will be evident particularly in FIGS. 1, 3 and 7 the pivot arm 40, which may be, as shown best in FIG. 1, of multiple side by side member construction, has a bent configuration in which the upper sections 41 and 42 extends at a somewhat different angle from the lower sections 45 and 46. Otherwise the central pivot point on the handle 20 would tend to be too low to allow the shovel blade to be efficiently lifted high enough to place snow on earlier piled snow. It may be desirable to include a small handle, not shown, at the end of the pivot arms 41 and 42 for auxiliary control of the pivot arm in handling the shovel, the lifting force, however, still being applied by the foot of the user pressing down in the stirrup 60.

FIGS. 8 through 15 illustrates an alternative and presently most preferred embodiment of the invention. The preferred embodiment of FIGS. 8 through 15, in which FIG. 15 is a construction parts list for such embodiment, is substantially similar to the somewhat less preferred embodiment shown in FIGS. 1 through 7 and the same reference numerals are used in the two sets of views (except for the construction part numbers in FIGS. 14 and 15), except where differences in parts occur, in which case an appropriate letter designation is applied to the appropriate reference designation in FIGS. 8 through 13 to distinguish from similar designations in the prior drawings of FIGS. 1 through 7.

Figure 13:
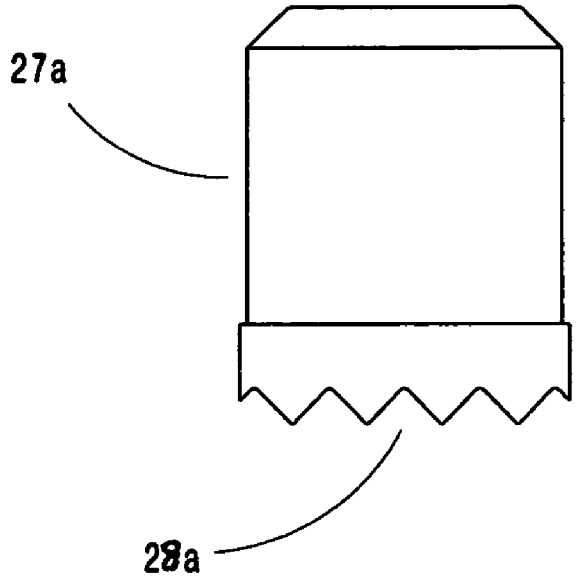
Figure 12:
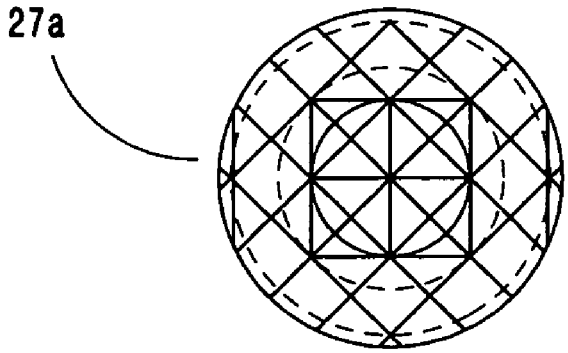
FIG. 12 is a lower view and FIG. 13 a side view of a preferred nonskid insert for placement in the lower ends of the handle section of the shovel of the invention and showing the hardened steel surface of such insert.

The principal difference between the embodiment in FIGS. 8 through 14 as shown best in FIGS. 8 through 13 is a 45 degree curve at the bottom of the shovel handle so that the end of the handle bears directly upon the underlying surface when the handle is held at a 45 degree angle. The ground engaging or nonskid portion of insert 27*a*, shown individually in FIGS. 12 and 13, is held in the end of the shovel handle by a jam fit or other appropriate manner with the teeth 27*b* exposed. The teeth 27*b* of ground engaging member 27*a* are made from hardened steel or alloy steel with preferably a waffle pattern type sharpened surface 27*b* providing nonslip or nonskid characteristics for secure engagement with the ground surface, concrete surfaces such as sidewalks and the like and even steel plates or bridging sometimes used on travel surfaces. Such nonskid characteristics are especially important in icy conditions where the rubber or other similar ground contact member shown in the embodiment of FIGS. 1 through 7 may not be sufficiently stable. The same sort of ground engaging member may be used with the embodiment of FIGS. 1 through 7. The other major difference between the preferred embodiment of FIGS. 8 through 13 from the previous figures is that the pivot arm 40*a* upon which the shovel blade 30 is mounted on one end with the stirrup 60*a* attached to the other end is straight throughout as is made possible by placing it lower on the shovel handle.

Figure 8:
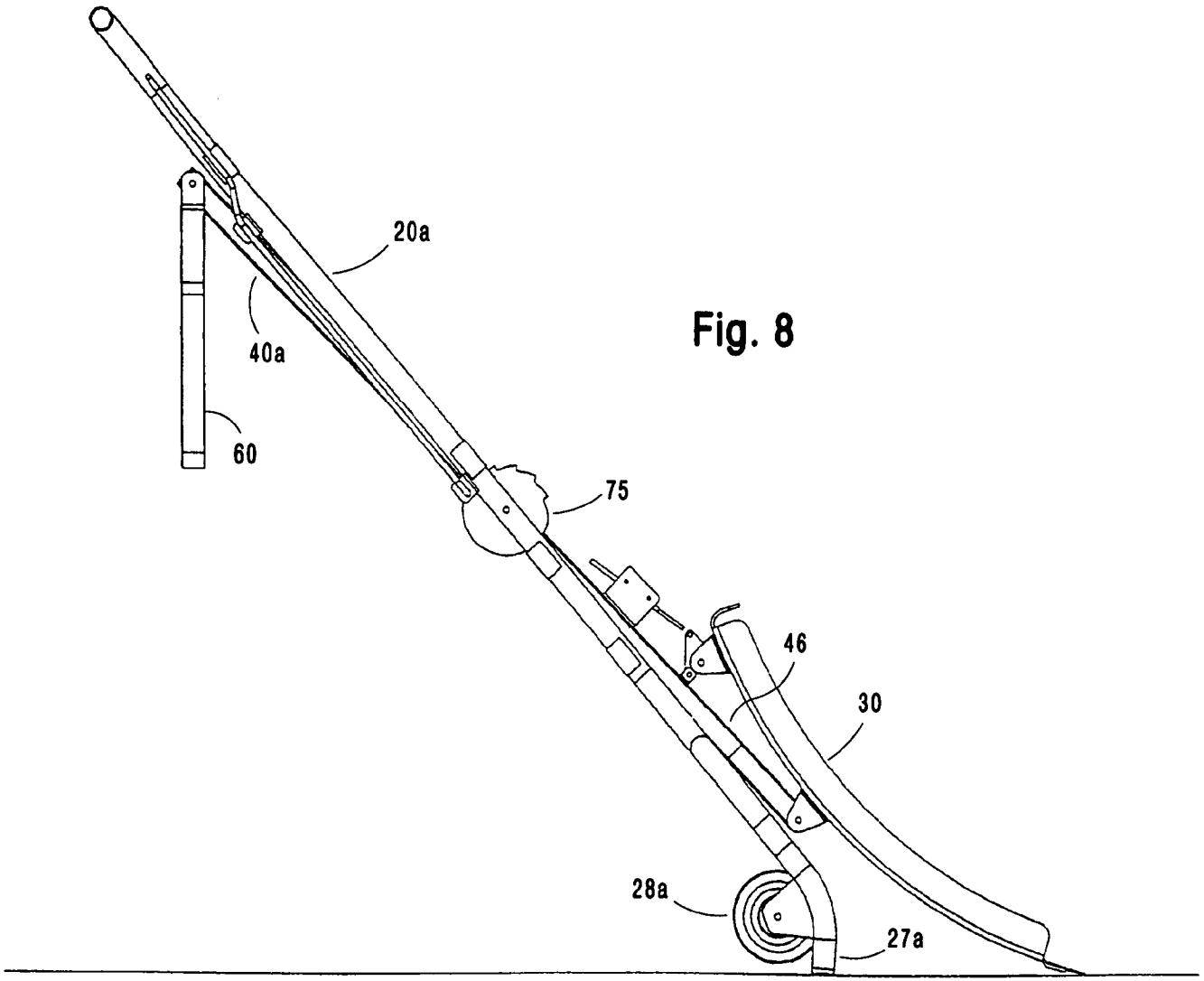
FIG. 8 is a side elevation of an alternative embodiment of the invention as shown in the previous drawings in which further embodiment the handle of the shovel is curved to approximately a 45 degree angle at the bottom about the axis of the ground engaging wheel and the pivot lifting arm has a straight configuration.
Figure 9:
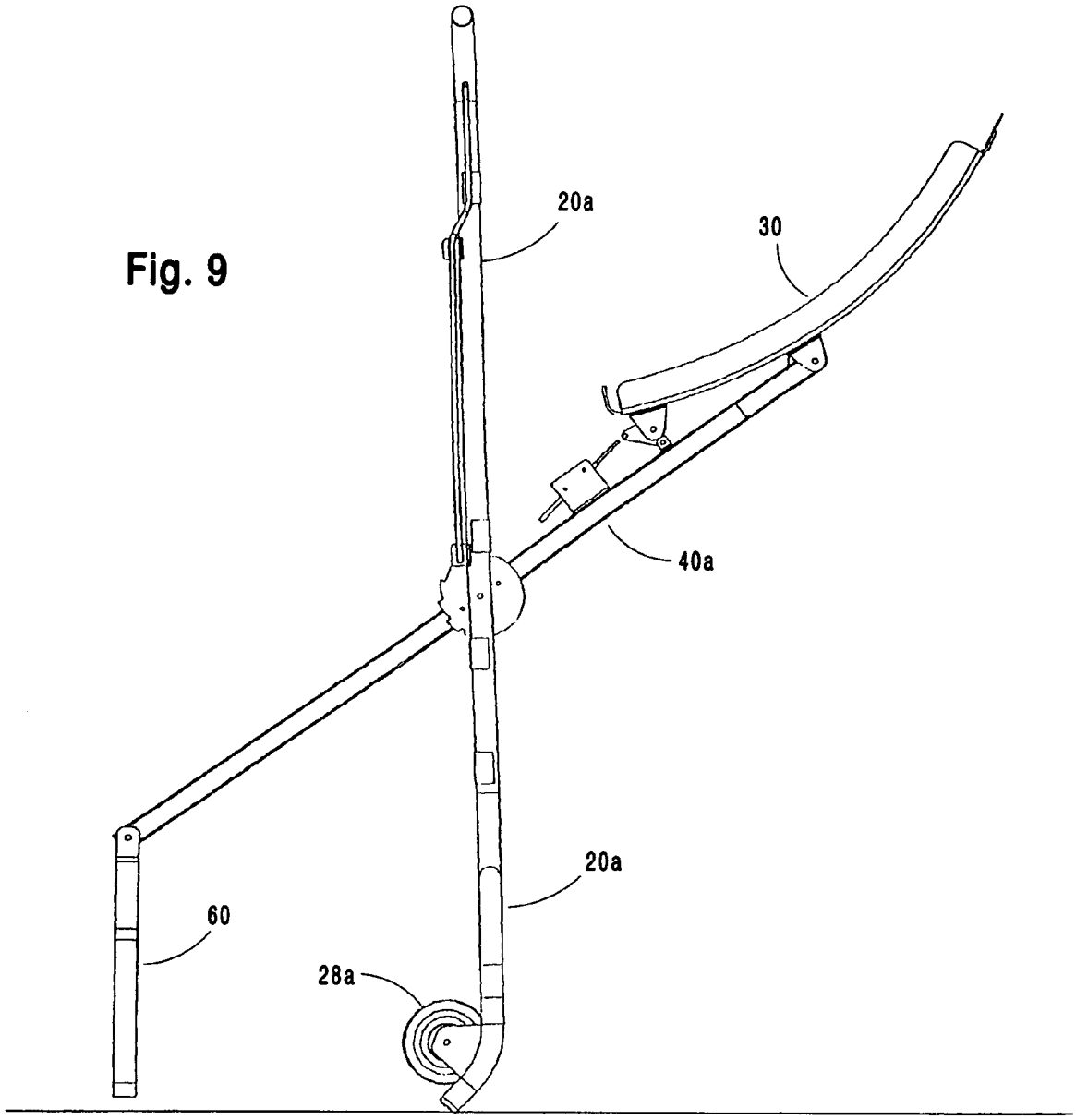
FIG. 9 is a further side elevation of the embodiment shown in FIG. 8 with the handle elevated to a vertical position and the pivot lifting arm elevated to substantially maximum position.
Figure 10:
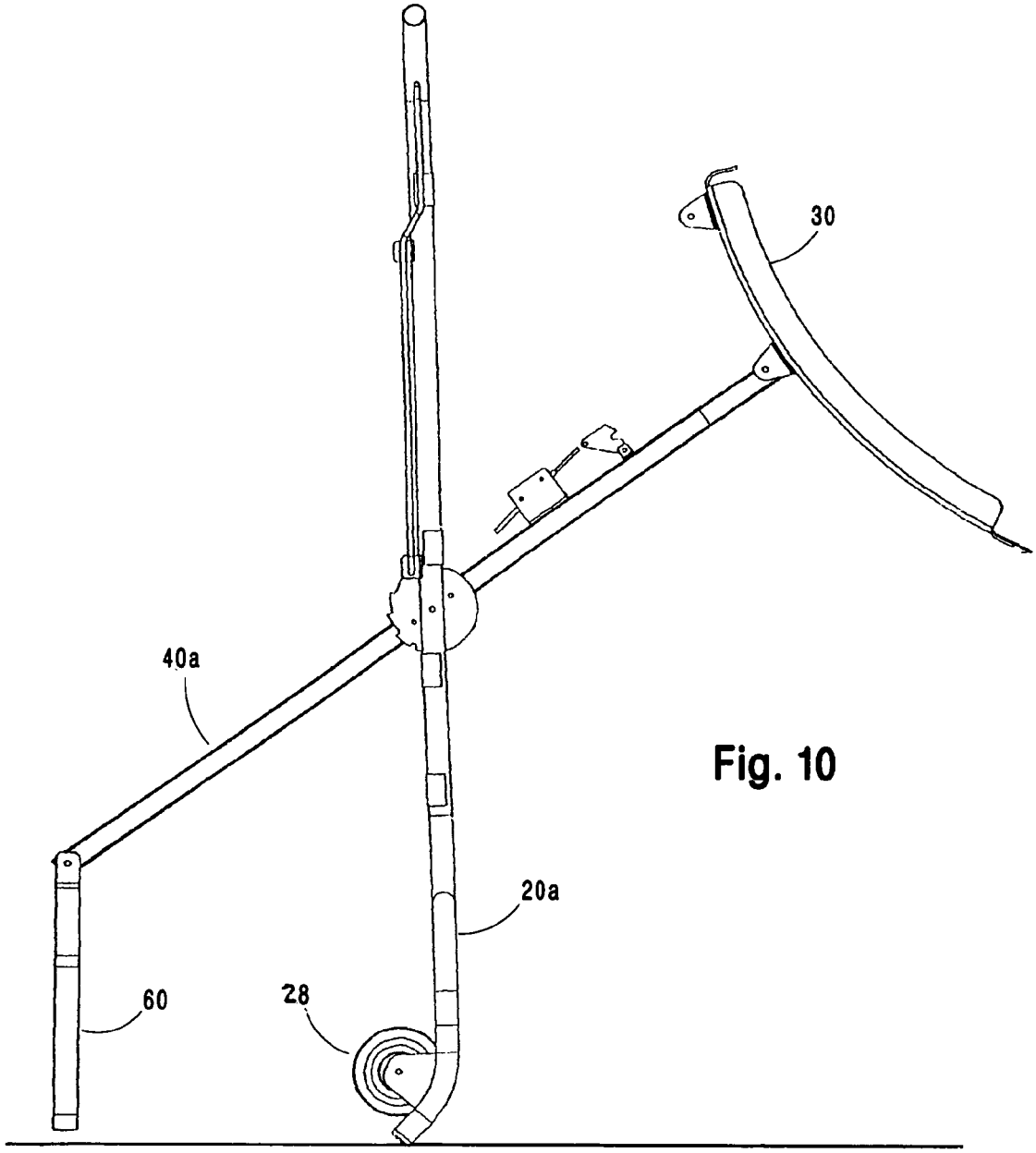
FIG. 10 is a further side elevation of the embodiment shown in FIGS. 8 and 9 with the shovel blade unlocked and rotated partway downwardly.
Figure 11:
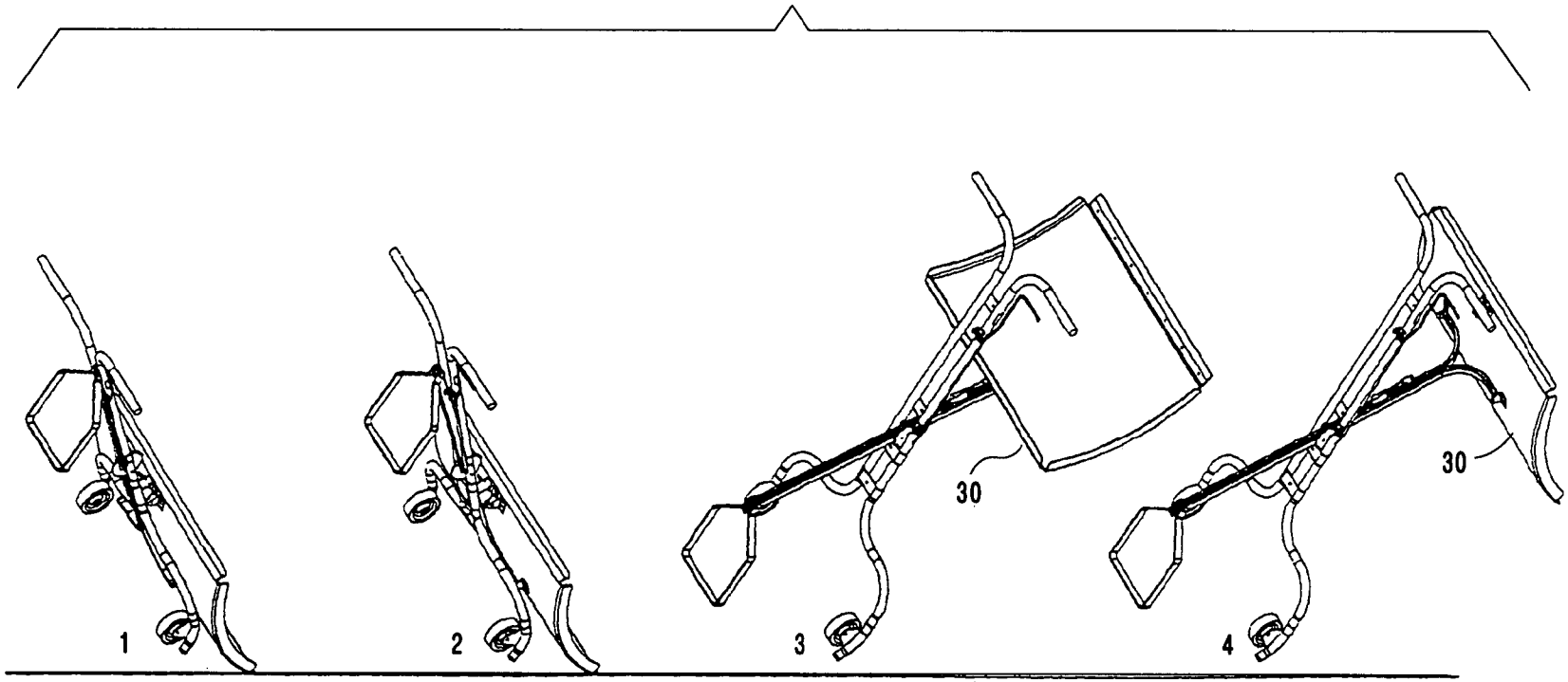
FIG. 11 is a four part time lapse sequence of the embodiment of the invention shown in FIGS. 8, 9 and 10 in two initial plowing or scooping modes, a third elevated mode and a fourth shovel blade dumping mode.

As more particularly shown in FIGS. 8 and 10, a shovel user may begin shoveling or plowing of snow with the ground contacting insert 27*a* essentially flat on the ground surface and the wheel or wheels of the handle just off the ground. If it is desired to pass the shovel blade over the ground in a more nearly horizontal position or to rest the wheels 28 on the ground the handle 20*a* may be tipped back a little farther so the weight of the shovel and any snow held thereon rests on the said wheels 28 mounted on the bottom of the handle by wheel mounting bracket 67. When the shovel is brought opposite a disposal area the handle 20*a* may be brought to a more vertical orientation as shown in FIG. 9 and the foot of the operator placed in the stirrup 60*a* to raise the pivot arm 40*a* as shown. Unlocking upper portion of the shovel blade 30*a* from the pivot are 40*a* will then allow the blade 30*a* to rotate as shown in FIG. 10, or even farther, dumping any snow accumulated on the blade from the blade. If the snow is wet and tends to adhere or stick to the blade 30*a* the handle 20*a* can be shaken or sharply rocked frontward and backward to shake or jar the snow from such blade. Since the full weight of the shovel and any accumulated snow is supported upon the end of the handle as shown in FIG. 10 there is little or no stress or weight applied to the back or vertebral column of the shoveler. The sequence of pushing or plowing snow followed by lifting it and then dumping the snow is shown in time lapse sequence form in FIG. 11 progressing from the lower left of the figure to the upper right of the figure. It will be noted that the first two time lapse positions of the series of time lapse representations of the shovel of the invention are very nearly the same, except that the shovel blade is slightly more extended in the second time lapse view. In both initial time lapse sequences it should be understood that if the shovel is being moved on the wheels 28 the shovel handle 20*a* will be tipped or inclined to the rear sufficiently to cause the wheels 28 to contact or be supported by the ground surface.

Figure 14:
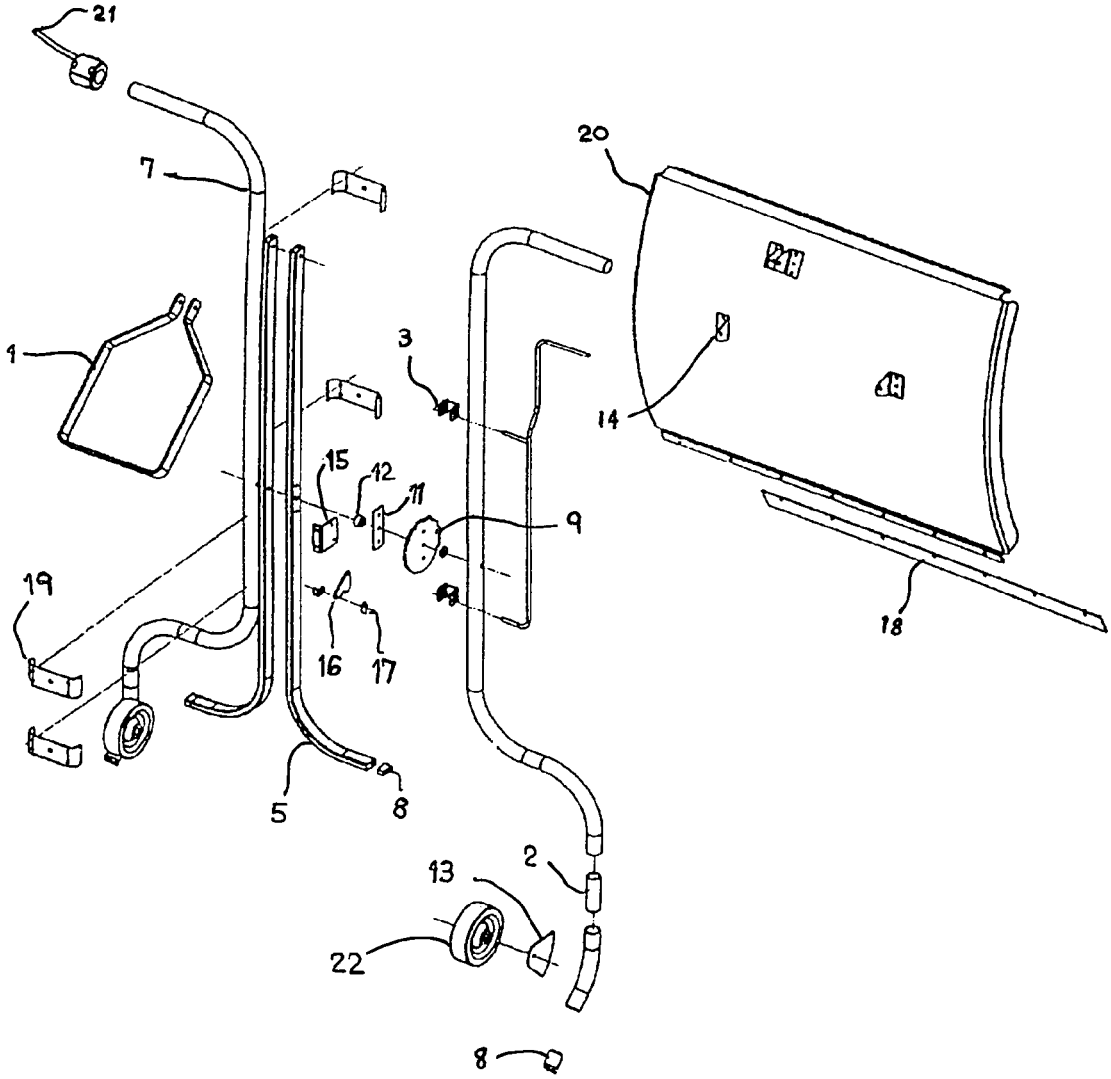

FIGS. 14 and 15, as indicated above, show in broken apart format and list the various component parts of the embodiment of the shovel shown in the FIGS. 8 through 13 with the Table of FIG. 15 listing such parts by sequential number and names of the construction parts. The reference numerals of the broken apart showing of FIG. 14 are the sequential numerals of the parts list of the Table of FIG. 15 and not the operational numerical representations of FIGS. 8 through 13 which conform, where similar, to the reference numerals of FIGS. 1 through 7 showing the first embodiment of the invention.

Figure 16:
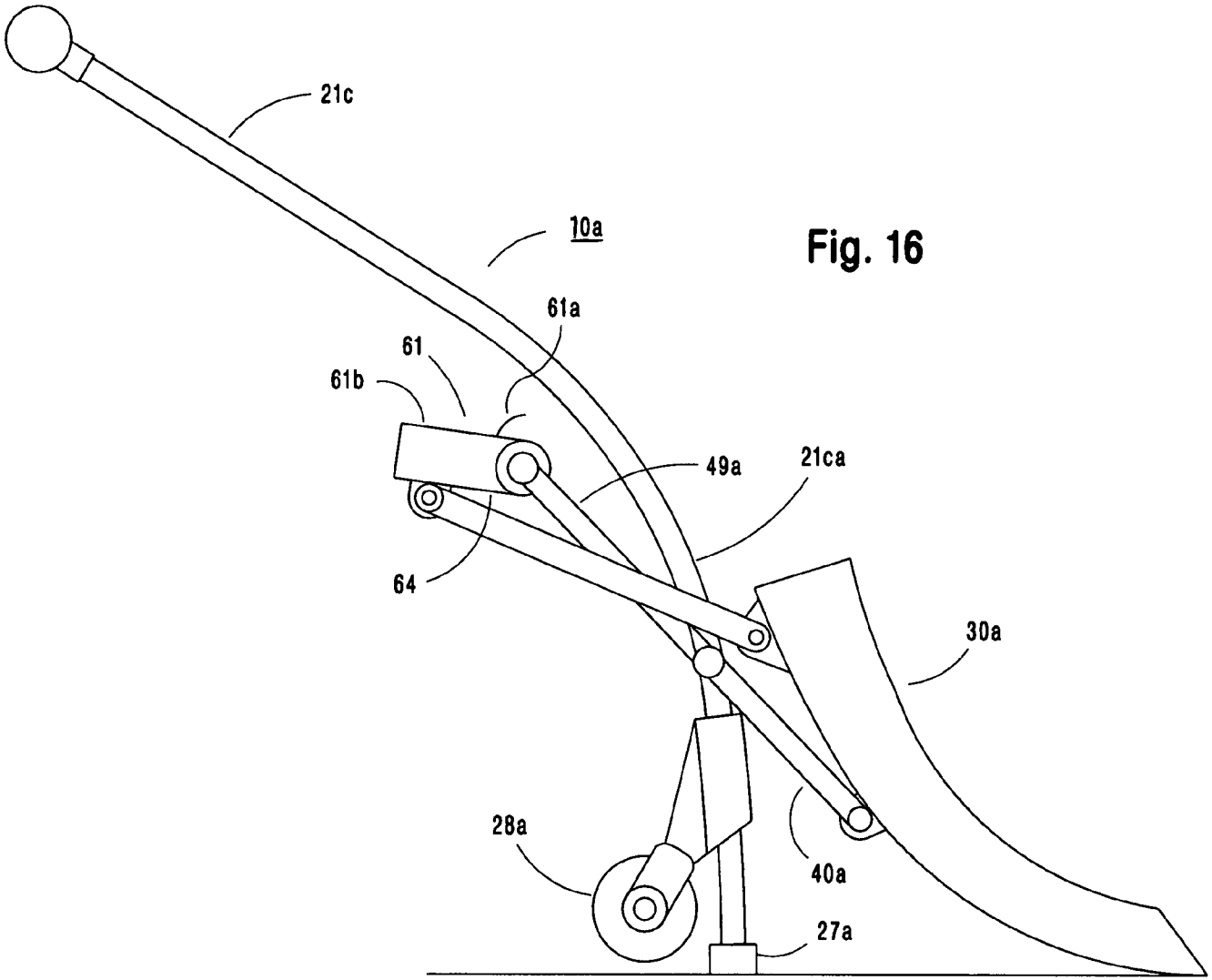
FIG. 16 is a diagrammatic side view of an alternative embodiment of the invention making use of a push rod controlled by a foot pedal to control the position of and dump the shovel blade.

FIG. 16 is a diagrammatic side elevation of an alternative version of the invention in which instead of the use of a foot stirrup to lift the shovel blade by downward pivoting of the pivot rod, there is instead a foot pedal to which force is applied plus an additional push rod attached to the foot pedal so that when the foot pedal is physically rotated the push rod actively forces the top edge of the shovel blade out to dump snow from such blade rather than allowing the shovel blade to passively rotate itself from overbalancing.

As shown in FIG. 16, a shovel device 10*a* in accordance with the invention has in this case a support shaft 20*a* having a curved handle member 21*c* with ground contact end piece 27*a* and wheel 28*a* held on a wheel mount 67 attached to the lower portion of the curved handle 21*c* which as may be seen is particularly curved in the central section 21*ca* of such handle. A shovel blade 30*a* is pivoted to the end of a pivot or fulcrum arm 40*a* thereby establishing a base or fulcrum on which blade 30*a* may be pivoted upwardly. Preferably there will be two fulcrum arms 40*a* designated here as arms 41*a* and 42*a* preferably pivotably mounted on opposite sides of the handle 21*c* or, if the handle is itself of double construction, the pivot arms 41*a* and 42*a* will be on the two handle sections. To lift blade 30*a*, the user places his or her foot on the foot pedal 61 and applies an even downward force thereon, the force being applied mainly directly to the front section 61*a* where the pivot arms 41*a* and 42*a* are rotatably pivoted with it. As such force is applied, arm 41*a* and 42*a* will pivot on pivot point 48 with handle 21*c*, with the upper ends of arms 41*a* and 42*a* pivoting downwardly and the lower ends of such arms pivoting upwardly so that blade 30*a* is lifted off the ground surface. The loaded scoop or blade 30*a* thus is lifted with only minimal exertion or strain on the body of the user. In fact, the user's body weight on the foot pedal is all that is normally required to lift the load, and only minimal or no further stress is applied on the user's back, shoulders, or arm muscles and/or joints in contrast to what is typically experienced when manually lifting a loaded shovel blade or scoop. The user has therefore replaced a second and third grade lever system, i.e. the combination body and regular shovel handle lifted by the arms, with a first grade lever having a fulcrum point between the load and the lever and operated by the strong muscles of the legs or one leg. In addition, rather than the load being supported by the vertebral column of the shoveler, the load is supported by the handle of the shovel.

As indicated above, once the blade with the load thereon has been lifted using the lever mechanism as just described, the entire weight of the load is supported on shaft 21*c*, and is held in such raised position by the downward pressure exerted on foot pedal 61 by the user's foot and body weight. Now the load must be dumped or removed from the blade in a suitable dumping area. To accomplish this, while still gripping the handle members 21*c* the shovel blade may be pivoted forwardly by pressing downwardly on the rearward end of the foot pedal with the foot. As will be understood from FIG. 16, this causes the rearward end 61*b* of the foot pedal 61 to move downward so that it is substantially below the forward end. Moving it downwardly, however, also, as may be seen in FIG. 16 will effectively pivot or move rear end 61*b* forwardly with respect to the shovel as a whole. Pivoting the rearward end 61*b* of the foot pedal 61 downwardly also causes push rod or rods 65 to slide or be pushed forwardly without substantially effecting the angle or height at which arms 41*a* and 42*a* hold the shovel blade. Downward movement of the rearward end of foot pedal 61 therefore causes push rod or rods 65 to slide forwardly. This in turn causing the top edge 32*a* of blade 30*a* to be pushed forwardly and blade 30*a* to tilt from a more horizontal position to a more vertical position, thereby allowing the snow load to fall off of the blade. The length of the pivoting foot pedal and the extent to which it is rotated determines how far forward the top edge of the shovel blade 30*a* is pushed forward. To further aid in dumping the load, at the same time the user may pivot shaft 20*a* upwardly and forwardly, and shake the device, with the lower end of shaft 20*a* still in contact with the ground surface, which will tend to cause any adherent snow to be detached from the blade. Once all of the snow has been removed from the blade, the user may then return the blade to its lowered position simply by removing his or her foot from the foot pedal 61 and allowing the blade to naturally pivot downwardly on the pivot rods 41*a* and 42*a*. The device is now ready to be used to pick up another load. It will be evident that the same sort of ratcheting mechanism may be used in the embodiment shown in FIG. 8 as in the previous figures to hold the pivot arm 40*a* with the shovel blade 30*a* in an elevated position.

While previous snow removal devices have utilized lever mechanisms to lift a shovel load to waist height, an important difference and advantage of the present inventor's arrangement is that the lower end of shaft or handle 20 also serves as the fulcrum or ground-engaging member, while in prior art manual shoveling devices the shaft is connected directly to the shovel with the lever connected only to the handle shaft. The present inventor's arrangement allows the handle to remain more or less stationary and disposed at the same angle while collecting snow on the shovel blade after which the foot pedal is used to lift the loaded shovel blade, so that less bending and force on the arms and back is required. In addition, in prior art pivotable shoveling aids, the pivot point for pivoting the blade upwardly is in a position on the handle shaft above the height of the shovel blade. In the present inventor's arrangement, however, the pivot point may be moved from a position generally above the shovel blade on the standard handle to a position an inch or two behind the shovel blade. Such lower pivot position spaced behind the shovel blade allows the lever mechanism, because of the effectively greater leverage, to be used to lift the shovel blade using a lesser downward force than if the pivot point was above the blade on the handle shaft. In addition, a more sturdy and stable base or fulcrum for pivoting the blade is provided. A novel arrangement for dumping snow off the shovel blade by further rotating the foot pedal is also provided.

In an alternative embodiment, the snow removal device of the invention may also include a means for locking the shovel blade in a raised position. As a result, once such lock is engaged, the user does not have to keep his or her foot on the foot pedal to maintain the shovel blade in a raised or substantially horizontal position. Another advantage is that the user may now more easily transport the loaded snow shoveling device to a remote dumping location on wheels 28. Such locking may be an automatic locking mechanism incorporated into pivot 48 arrangement as in FIGS. 1–2 in the form of a ratchet mechanism so that when the blade is pivoted or lifted upwardly and reaches a certain point or position, the lock will automatically engage and hold the blade in such position. Alternatively, a manual lock such as a push lock may be used.

Figure 17:
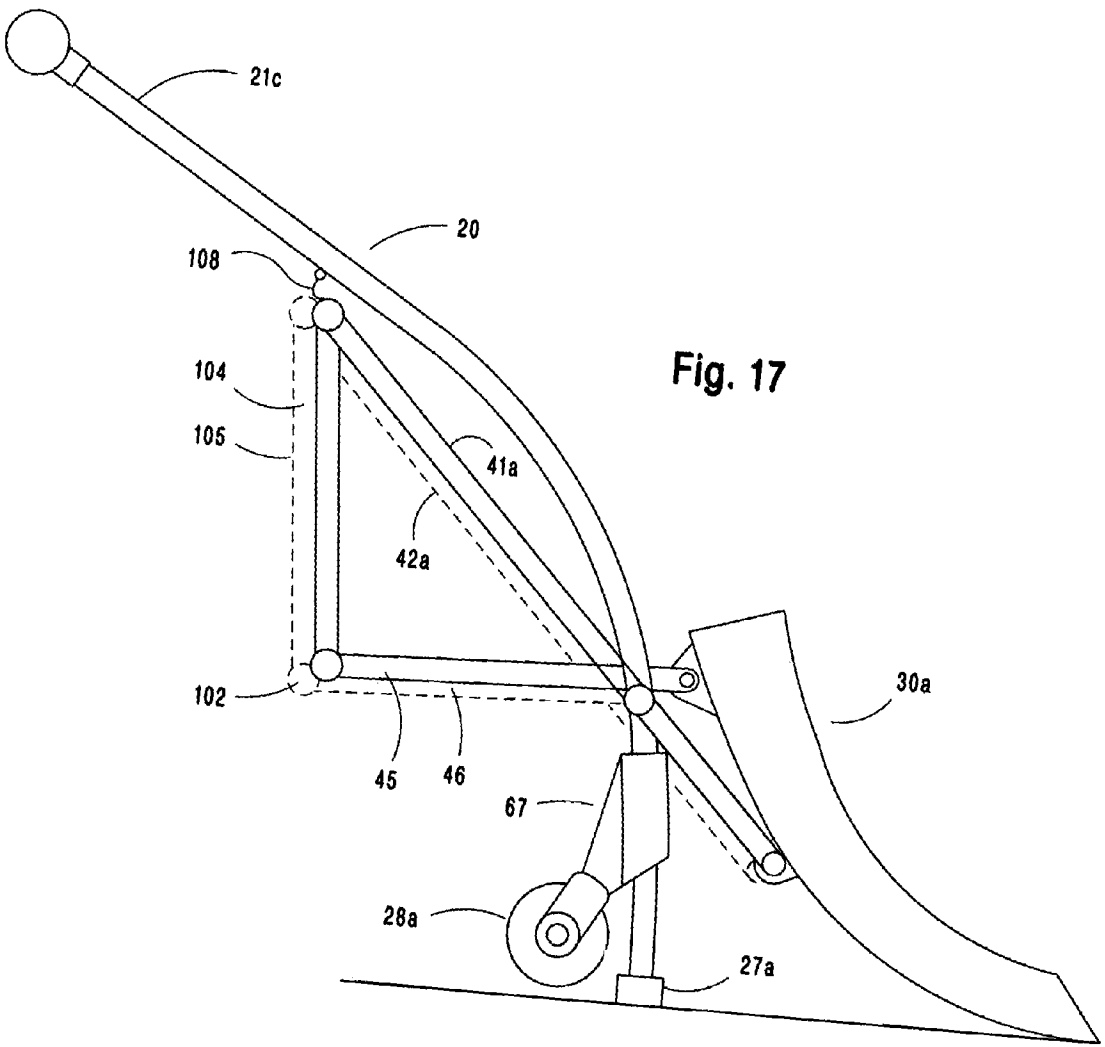
FIG. 17 is a diagrammatic side view of a still further embodiment of the invention using a swing bar for control of a push rod by the foot of the user to control the position of and dump snow from the blade of the shovel.

FIG. 17 illustrates diagrammatically another alternative embodiment of the snow removal device of the invention similar to that shown in FIG. 8. In such embodiment the structure of handle shaft 21*c* and blade 30*a* have not been changed, and blade 30*a* is still secured to shaft 20 by support or pivot arms 41*a* and 42*a*. However, in such further embodiment, foot pedal 61 of FIG. 8 has been replaced with bar or stirrup 102 extending between the upper ends of push rods or braces 45 and 46, and arms 104 and 105 pivotably connected between the upper ends of support pivot arm 41 and support pivot arm 42 and brace 46, respectively. A hook 108 is provided to hold the upper ends of support arms 41*a* and 42*a* in close proximity to handle shaft 21*a* during actual shoveling. It is then unhooked when the load of snow is to be lifted. As will be noted, the doubling of pivot arm members 41*a* and 42*a*, push rods 45 and 46 and pivot arms 104 and 105 are diagrammatically shown by broken line phantom representations.

In use, after the snow removal device 10 is used to gather a load on blade 30*a*, the user will exert a downward pressure on bar or stirrup 102, which will cause blade 30 to be lifted off the ground and into a generally horizontal position. Thereafter, forward pressure may be placed on stirrup 102, causing brace or push rod members 45 and 46 to move forwardly and tilt blade 30*a* outwardly so that the load on blade 30*a* is released to a suitable dumping area. A locking means such as described above may also be integrated into such embodiment to aid in holding the blade in a horizontal position so that once loaded it may be moved to a suitable dumping area without having to maintain a constant downward pressure on the stirrup bar. The presently described embodiment generally is operated in the same manner as the previously described embodiment.

Figure 19:
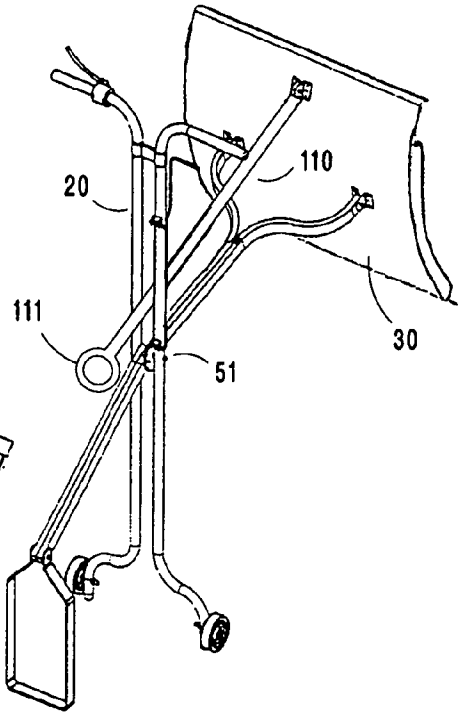
FIG. 19 is an isometric view similar to FIG. 6 but with the blade pushed forward by the push rod to snow dumping position.
Figure 18:
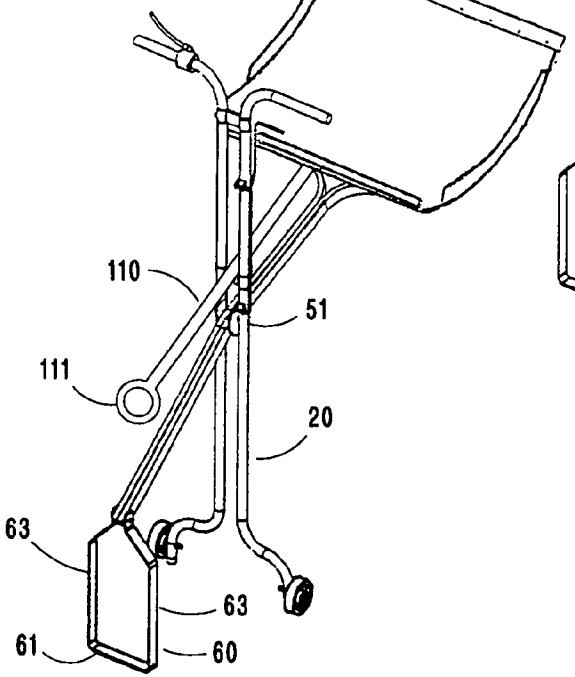
FIG. 18 is an isometric view similar to FIG. 4 but showing the use of a separate push rod to control the attitude of the shovel blade.

FIGS. 18 and 19 illustrate another alternative embodiment similar to that shown in FIGS. 4 and 6 wherein the snow removal device has been modified to include an active rotation system, rather than a passive blade release means for allowing blade 30 to passively pivot forwardly on support arms 41 and 42 when unlocked. As illustrated, an active independent push rod 110 for actively pushing the top of the blade outwardly can be used to cause it to dump its load of snow. The push rod 110 includes a hand grip or ring 111 to aid in operating such push rod and is pivotally connected to the upper portion of the shovel blade so that the angular disposition of such shovel blade can be controlled by said push rod 110 as may be seen in FIGS. 10 and 11. The loaded shovel blade is still lifted by foot pressure applied in the stirrup 61.

Figure 20:
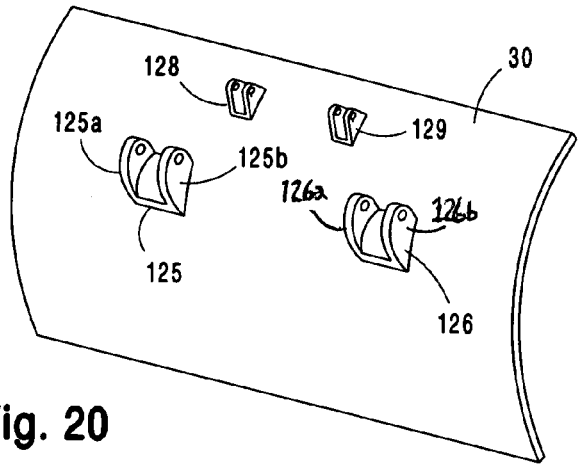
FIG. 20 is an isometric view of the rear of the shovel blade with fittings for use in holding the blade to the handle via the pivoting lift or fulcrum rod plus upper fittings for attachment to a push rod as in FIGS. 18 and 19.
Figure 21:
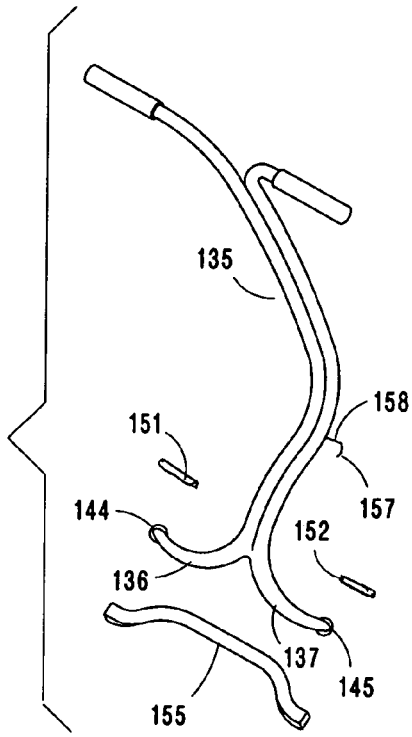
FIG. 21 is a view of a separate handle that can be attached to the blade of FIG. 12 to form a regular or more conventional shovel.

FIGS. 20 through 23 show how the shovel blade 30 of the invention may, if desired, be removed from its regular handle and associated pivoting lifting arm and a regular or conventional shovel handle attached to such blade for use as a conventional shovel in a conventional mode. In FIG. 20 there is shown a right rear quadrant isometric view of the shovel blade 30*a* used in the embodiments of the invention shown in FIGS. 16 and 17. It should be understood, however, that a conventional shovel handle supplied with appropriate attachment means could be used with the shovel blades shown in FIGS. 1 to 7 or in FIGS. 18 and 19. In FIG. 20 the back of the shovel blade is provided with brackets 125 and 126 in the form of modified channel members having opposed flanges 125*a*, 125*b* and 126*a*, 126*b*. Two other smaller channel sections 128 and 129 are supplied on the top portion of the back of the shovel blade. These channel brackets 125*a* and 126*a* are normally used for movable connection of the pivot rods 41*a* and 42*a* which are secured by suitable pins to the brackets. Likewise, the brackets 128 and 129 are normally secured by suitable pins to the push rods 65 and 66. As shown in FIG. 21, a handle 135 is provided with a split or bifurcated lower and 136 and 137 and openings in lower narrow sections 144 and 145 which are adapted to slide into the modified channel brackets 125 and 126 and be locked or held therein by pins 151 and 152. A further curved rod 155 is adapted to slide through opening 157 in bracket 158 on the front of the handle 135.

Figure 22:
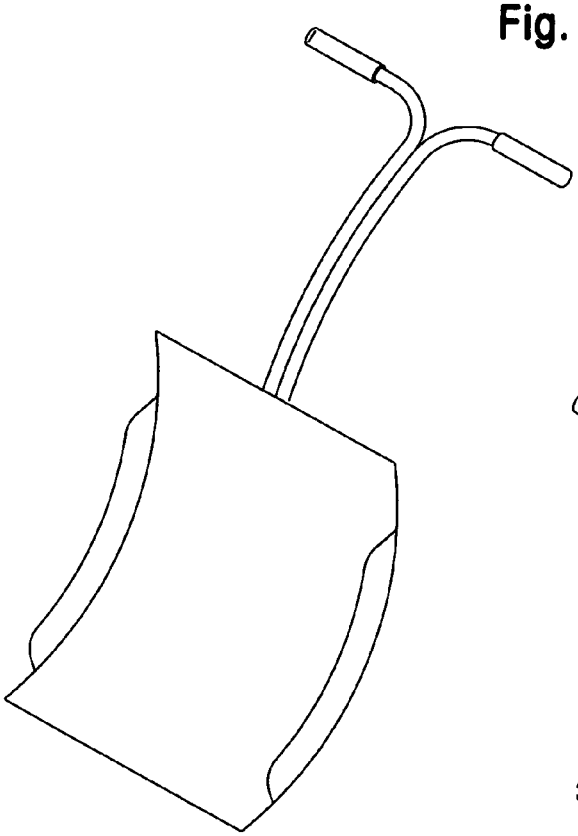
FIG. 22 is an isometric left front quadrant view of the separate handle attached to the shovel blade of FIG. 12 to form an ordinary shovel as distinguished from the mechanical lift aided shovel of the invention.
Figure 23:
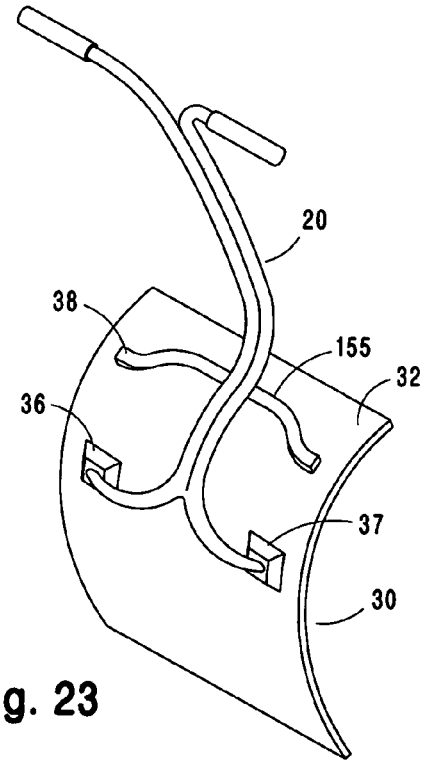
FIG. 23 is an isometric right rear quadrant view of the separate handle attached to the shovel blade to form a conventional shovel as distinguished from the blade of the mechanical lift shovel of the invention.

As will be understood from reference to the FIGS., when it is desired to use the shovel blade in a conventional manner, it can be separated from the handle 20 or 20*a* of the invention by removing the pins from the brackets on the shovel blade and replacing such handle by the conventional handle as shown in FIGS. 21, 22 and 23. The conversion only takes a few moments and facilitates double duty for the shovel blade. The arrangement also allows the shovel blade, particularly when made from a plastic material which may wear over an extended period, to be easily and quickly replaced on the mechanical handle of the invention even though the use of a conventional handle may not be desired.

As will be understood from the forgoing description and accompanying drawings the invention as described allows shoveling and movement of snow without applying any significant stress to the arms or spine of the shoveler enabling many persons who could not otherwise effectively shovel snow to do so and significantly reducing the possibility of injury in doing so for large numbers of others.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A snow removal tool comprising:

(a) an elongated shaft forming a handle, said shaft having an upper end, and a lower end extending downwardly adapted for resting in proximity to the ground, said upper end having a handle grip means connected thereto, and said lower end comprising a ground contacting end means;

(b) a shovel blade having a lower edge, upper edge, side edges, and front and rear sides; and (c) lever means pivotably connected between the shovel blade and said elongated shaft, said lever means extending beyond said shaft and including a foot-engaging member for operating said lever means arranged so that when a downward force is applied on the foot-engaging member while the elongated handle is supported in a generally upright mode resting upon the ground contacting means, the shovel blade is pivoted upwardly relative to the shaft.

2. The snow removal tool of claim 1 additionally comprising:

(d) means for effecting removal of frozen precipitation material from the shovel blade while in an elevated position.

3. The snow removal tool of claim 2 wherein the means for effecting removal of frozen precipitation material is a passive releasable lock means.

4. The snow removal tool of claim 2 wherein the means for effecting removal of frozen precipitation material comprises active push rod means.

5. The snow removal tool of claim 1 additionally comprising a latch means for releasably securing the lever means in close relation to the shaft.

6. The snow removal device of claim 5 additionally comprising a lock means for temporarily maintaining the shovel blade in a raised position.

7. The snow removal tool of claim 1 wherein said lever means is comprised of a primary lever arm secured to the rear of the shovel blade on one end and to the foot-engaging member on the other end, and also being pivotably secured to the elongated shaft at a point between said ends.

8. The snow removal tool of claim 7 wherein said lever means additionally comprises an auxiliary lever arm secured to the rear of the shovel blade on one end and the foot-engaging member on the other end.

9. The snow removal device of claim 8 wherein said lever means is comprised of first and second cooperating pairs of lever arms.

10. The snow removal device of claim 8 wherein said primary and auxiliary lever arms are pivotably secured to the shovel blade at different operative positions.

11. The snow removal device of claim 8 wherein the primary and auxiliary lever arms are pivotably secured to the foot-engaging member.

12. The snow removal device of claim 11 wherein said means for removing material from the shovel blade is accomplished by rotating the foot-engaging member downwardly and forwardly towards the handle, which causes the shovel blade to be tilted forwardly.

13. The snow removal device of claim 8 wherein the primary and auxiliary lever arms are connected to the rear side of the shovel blade by first and second joint members integrally molded with said blade and a connector means in the form of pins joining said first joint member to the primary lever arm and said second joint member to the auxiliary lever arm.

14. The snow removal tool of claim 7 additionally including an automatic locking and release means for holding the lever means together with the shovel blade in a position to which it has been elevated by foot pressure on the end of the lever.

15. The snow removal device of claim 1 additionally comprising a wheel means attached to the lower end of the shaft in a position so that when the shaft is tilted rearwardly the wheel will contact and support the device on the ground surface.

16. The snow removal device of claim 1 wherein said elongated shaft is comprised of two substantially mirror image tubular members.

17. A method of shoveling, lifting, and dumping comprising the steps of:

(a) pushing forwardly on a handle member of a snow device with a blade engaging the ground surface so that the blade is caused to slide along the ground surface so that a material is caused to accumulate on the blade;

(b) resting the lower end of the handle member upon an underlying surface;

(c) raising the shovel blade from the ground a suitable distance by pressing downwardly on a foot-engaging member to lift the blade relative to the handle member by means of a levered arm arrangement;

(d) orienting the shovel apparatus to a suitable dumping area; and (e) moving the blade to a substantially vertical position on the levered arm arrangement to dump from it.

18. A method of shoveling, lifting and dumping in accordance with claim 17 wherein the blade is rotated to a substantially vertical position by releasing a locking means and allowing it to be rotated by gravity acting upon an off center rotatable connection to the leveraged arm arrangement.

19. A method of shoveling, lifting and dumping snow in accordance with claim 17 where in the blade is actively rotated to a substantially vertical orientation by a push rod arrangement to which force is applied.

20. A method of shoveling, lifting and dumping in accordance with claim 19 wherein the push rod arrangement is activated by the force applied thereto.

21. A method of shoveling, lifting and dumping in accordance with claim 19 wherein the push rod arrangement is activated manually.

22. A method of shoveling, lifting and dumping in accordance with claim 17 wherein the material is snow.

* * * * *